United States Patent [19]

Iwase et al.

[11] 4,366,477

[45] Dec. 28, 1982

[54] DOT MATRIX TYPE RUNNING DISPLAY PANEL FOR USE IN ELECTRONIC CALCULATORS OR THE LIKE

[75] Inventors: Tetsuo Iwase, Nara; Mituhiro Saiji, Kyoto, both of Japan

[73] Assignee: Sharp Kabushiki Kaisha, Osaka, Japan

[21] Appl. No.: 140,657

[22] Filed: Apr. 15, 1980

[30] Foreign Application Priority Data

Apr. 17, 1979 [JP] Japan ..... 54-47777

[51] Int. Cl.[3] ..... G09G 3/20

[52] U.S. Cl. ..... 340/792; 340/756; 340/804

[58] Field of Search ..... 340/792, 789, 791, 798, 340/804, 756

[56] References Cited

U.S. PATENT DOCUMENTS

| | | | |
|---|---|---|---|
| 3,493,956 | 2/1970 | Andrews et al. | 340/792 |
| 4,068,226 | 1/1978 | Bowman et al. | 340/792 |
| 4,192,413 | 4/1980 | Sowa et al. | 340/792 |
| 4,205,312 | 5/1980 | Nelson . | |

*Primary Examiner*—Marshall M. Curtis

*Attorney, Agent, or Firm*—Birch, Stewart, Kolasch and Birch

[57] ABSTRACT

An electronic calculator with a dot matrix display panel capable of displaying characters, symbols or other patterns is implemented with a central processor unit (CPU). More particularly, when the length of characters is in excess of the capacity of the display panel, those characters are shifted dot by dot on the display panel in the running fashion. Numbers are displayed digit by digit, preferably.

2 Claims, 24 Drawing Figures

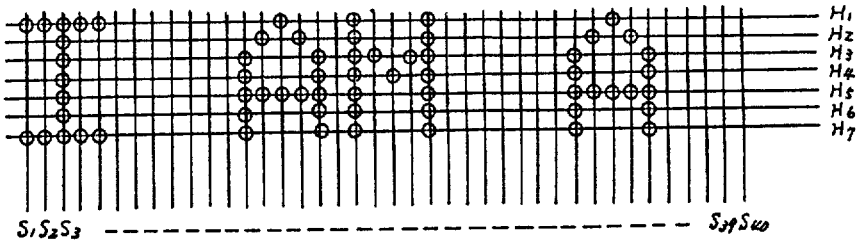
FIG. 6
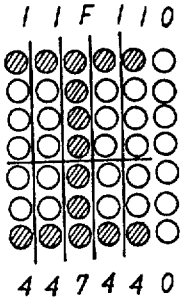
FIG. 7(a)
| | | | |
|---|---|---|---|
| 0 | 0000 | 9 | 1001 |
| 1 | 0001 | A | 1010 |
| 2 | 0010 | B | 1011 |
| 3 | 0011 | C | 1100 |
| 4 | 0100 | D | 1101 |
| 5 | 0101 | E | 1110 |
| 6 | 0110 | F | 1111 |
| 7 | 0111 | | |
| 8 | 1000 | | |
FIG. 7(b)

| step | process list |
|---|---|
| $n_2$ $n_3$ $n_4$ | (10) |
| $n_5$ $n_6$ $n_7$ | (8) |
| $n_9$ $n_{10}$ $n_{11}$ | (10) |
| $n_{12}$ $n_{13}$ $n_{17}$ | (9) |
| $n_{18}$ $n_{22}$ $n_{23}$ | |
| $n_{28}$ $n_{29}$ $n_{30}$ | (10) |
| $n_{31}$ $n_{32}$ $n_{33}$ | (8) |
| $n_{35}$ $n_{36}$ $n_{37}$ | (10) |
| $n_{38}$ $n_{39}$ $n_{43}$ | (9) |
| $n_{44}$ $n_{48}$ $n_{49}$ | |
| $n_{54}$ $n_{55}$ $n_{56}$ | (10) |
| $n_{57}$ $n_{58}$ $n_{62}$ | (9) |
| $n_{63}$ $n_{67}$ $n_{68}$ | |
| $n_{72}$ | (1) |
| $n_{109}$ | (5) |
| $n_{110}$ | (10) |
| $m_1$ | (15) |
| $m_2$ | (15) |
| $m_3$ | (1) |
| $m_6$ | (15) |
| $m_7$ | (15) |
| $m_8$ | (1) |
| $m_{13}$ | (15) |
| $m_{14}$ | (15) |
| $m_{15}$ | (1) |

FIG. 12(a)

| step | applied routine |
|---|---|
| $n_{14}$ $n_{15}$ $n_{16}$ | FIG. 9 |
| $n_{19}$ $n_{20}$ $n_{21}$ | |
| $n_{24}$ $n_{25}$ $n_{26}$ | |
| $n_{40}$ $n_{41}$ $n_{42}$ | |
| $n_{45}$ $n_{46}$ $n_{47}$ | |
| $n_{50}$ $n_{51}$ $n_{52}$ | |
| $n_{74}$ $n_{76}$ $n_{78}$ | FIG. 8 |
| $n_{80}$ $n_{82}$ $n_{84}$ | |
| $n_{92}$ $n_{94}$ $n_{96}$ | |
| $n_{99}$ $n_{101}$ | |
| $m_4$ $m_{11}$ $m_{18}$ | FIG. 9 |
| $m_{10}$ $m_{17}$ | FIG. 8×6 |

FIG. 12(b)

| | | |
|---|---|---|
| 0 --- 00000000 | a --- 00010000 | q --- 0010 0000 |
| 1 --- 00000001 | b --- 00010001 | r --- 0010 0001 |
| 2 --- 00000010 | c --- 00010010 | s --- 0010 0010 |
| 3 --- 00000011 | d --- 00010011 | t --- 0010 0011 |
| 4 --- 00000100 | e --- 00010100 | u --- 0010 0100 |
| 5 --- 00000101 | f --- 00010101 | v --- 0010 0101 |
| 6 --- 00000110 | g --- 00010110 | w --- 0010 0110 |
| 7 --- 00000111 | h --- 00010111 | x --- 0010 0111 |
| 8 --- 00001000 | i --- 00011000 | y --- 0010 1000 |
| 9 --- 00001001 | j --- 00011001 | z --- 0010 1001 |
| | k --- 00011010 | |
| | l --- 00011011 | |
| | m --- 00011100 | |
| | n --- 00011101 | |
| | o --- 00011110 | |
| | p --- 00011111 | |

FIG. 13

| |
|---|
| LDI 1 |
| LB 00 |
| STOR |
| LB 01 |
| STOR |
| LB 03 |
| STOR |
| LB 04 |
| STOR |
| LDI 4 |
| LB 10 |
| STOR |
| LB 11 |
| STOR |
| LB 13 |
| STOR |
| LB 14 |
| STOR |
| LDI F |
| LB 02 |
| STOR |
| LDI 7 |
| LB 12 |
| STOR |
| LDI 0 |
| LB 05 |
| STOR |
| LB 15 |
| STOR |

DOT MATRIX TYPE RUNNING DISPLAY PANEL FOR USE IN ELECTRONIC CALCULATORS OR THE LIKE

BACKGROUND OF THE INVENTION

This invention relates to a display device for use in electronic calculators or the like, and more particularly to a display device which achieves a unique display operation.

In the past, when it was desired to display data of a length more than the capacity of a display panel in an electronic calculator, the data to be displayed needed to be split into two or more groups in advance. In this case data expressing the same thought had to be split into groups which were inevitably separate and the connections between two adjacent ones of the data groups were indefinite and vague, leading to operator errors in recognizing the overall or combined contents being displayed. To overcome this problem, the same applicants of this application have proposed a unique device which shifts the contents of a display panel digit by digit at a given interval of time, as disclosed and illustrated in U.S. application Ser. No. 058,666, filed July 18, 1979, and entitled DISPLAY DEVICE FOR ELECTRONIC CALCULATORS OR THE LIKE.

It is therefore an object of the present invention to provide a display device which uses a dot matrix type display panel for displaying numbers, characters, symbols and similar patterns and shifts successively the overall contents on the display panel when the length of data to be displayed exceeds the capacity of the display panel, wherein the shifting movement of the display takes place dot by dot in a lateral direction.

It is another object of the present invention to provide a display device wherein either a conventional display mode (in other words, a static display mode) or a dot shift display mode is selectable with the former displaying keyed information or the results of arithmetic operations, for example, and the latter displaying instructions indicating the sequence of arithmetic operations in a dot matrix form mainly for use in function calculators.

BRIEF DESCRIPTION OF THE DRAWINGS

For a more complete understanding of the present invention and for further objects and advantages thereof, reference is now made to the following description taken in conjunction with the accompanying drawings, in which:

FIG. 6 is a schematic representation of a dot matrix display panel in the illustrated calculator;

FIG. 7(*a*) is an explanation diagram of a display pattern on the dot matrix display panel and FIG. 7(*b*) is a table for numerical binary codes;

FIG. 12(*a*) shows the relationship between respective steps and a process list and FIG. 12(*b*) is the relationship between the respective steps and applied routines;

FIG. 13 is a table showing the relationship between characters and their encoded signals;

DETAILED DESCRIPTION OF THE PREFERRED EMBODIMENTS

Figure 1:
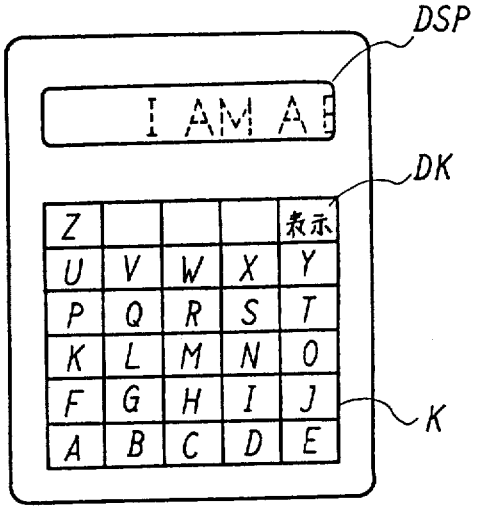
FIG. 1 is a plan view of an example of a programmable calculator embodying a display device according to the present invention.

Referring now to FIG. 1, there is illustrated a plan view of a programmable calculator having a display device constructed in accordance with one preferred form of the present invention, wherein a display device is generally designated DSP and a keyboard unit is generally designated K.

Figure 2:
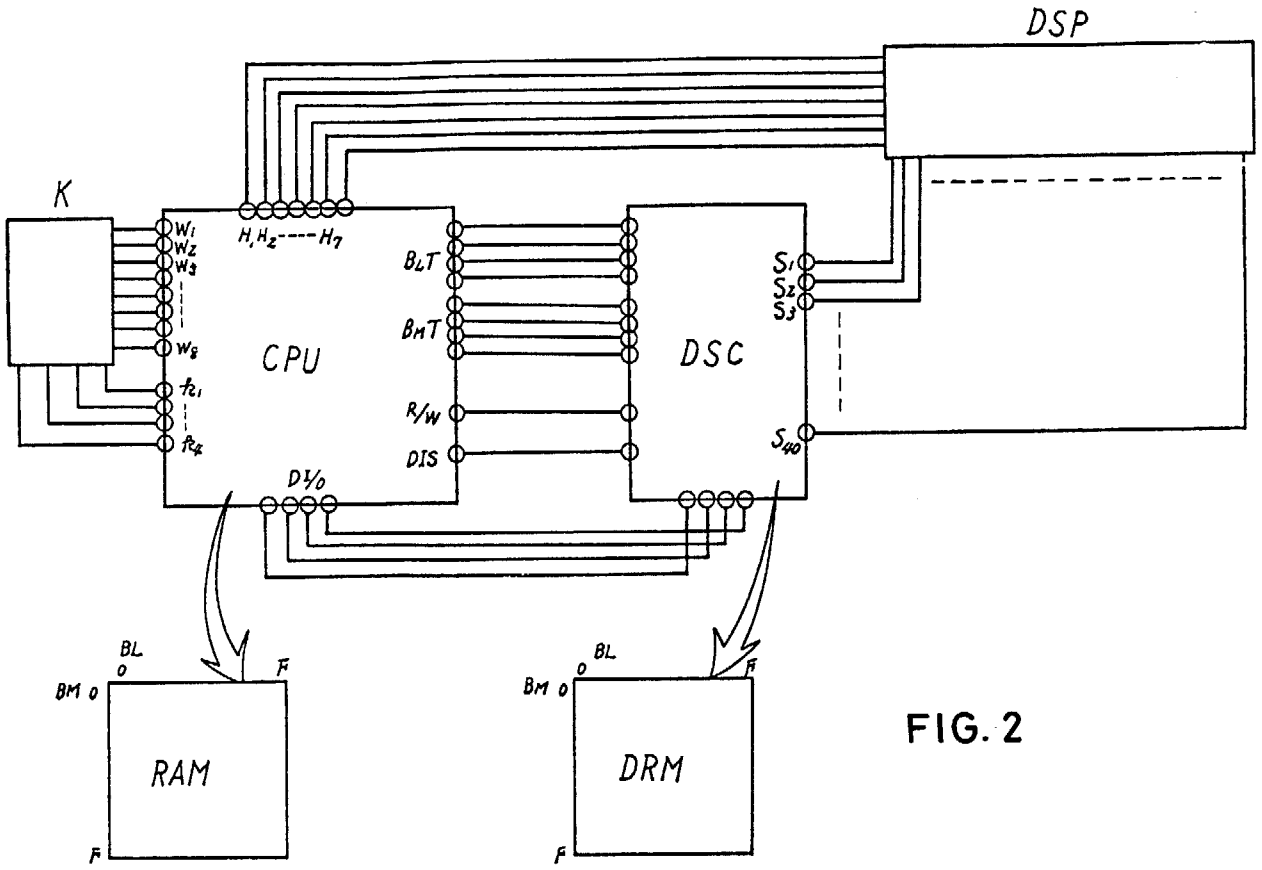
FIG. 2 is a schematic block diagram of a circuit arrangement of the illustrated calculator.
Figure 4A:
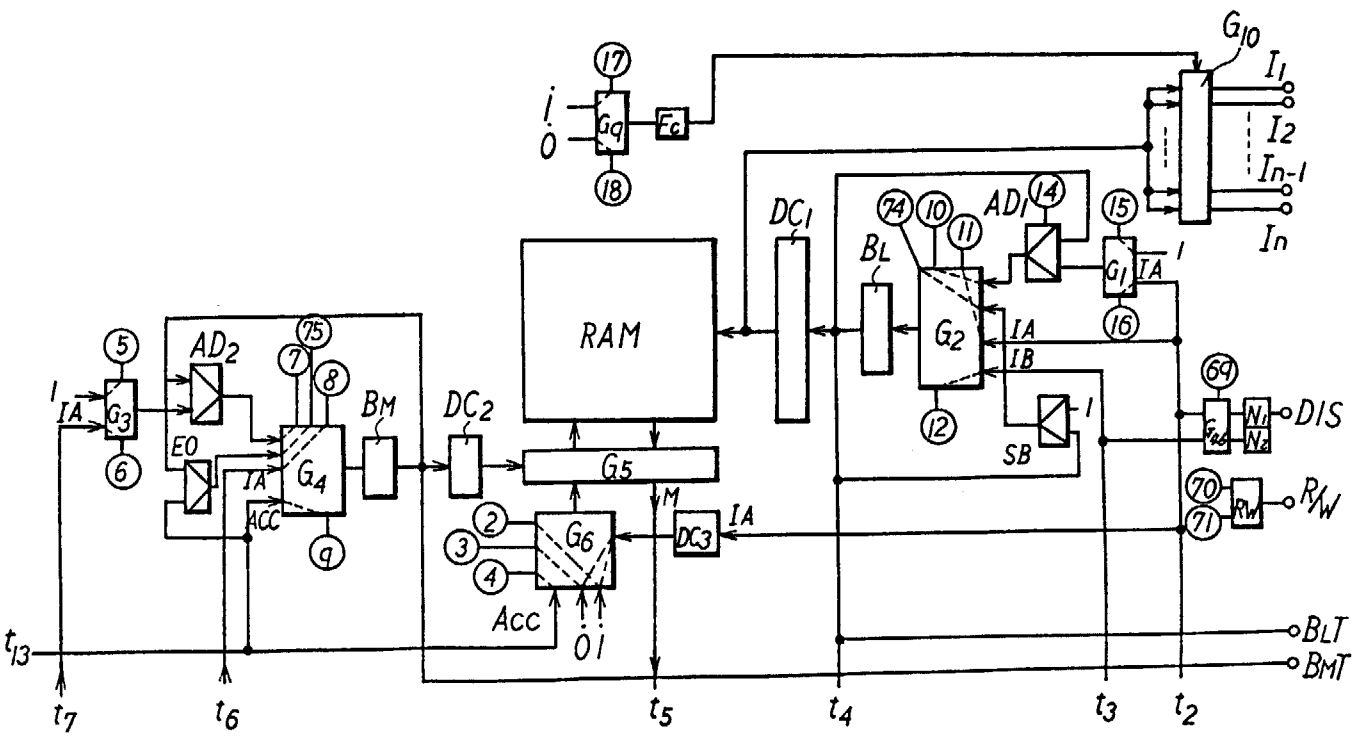
FIGS. 4A through 4D are logic diagrams of an example of a central processor unit (CPU) in the illustrated calculator.
Figure 4B:
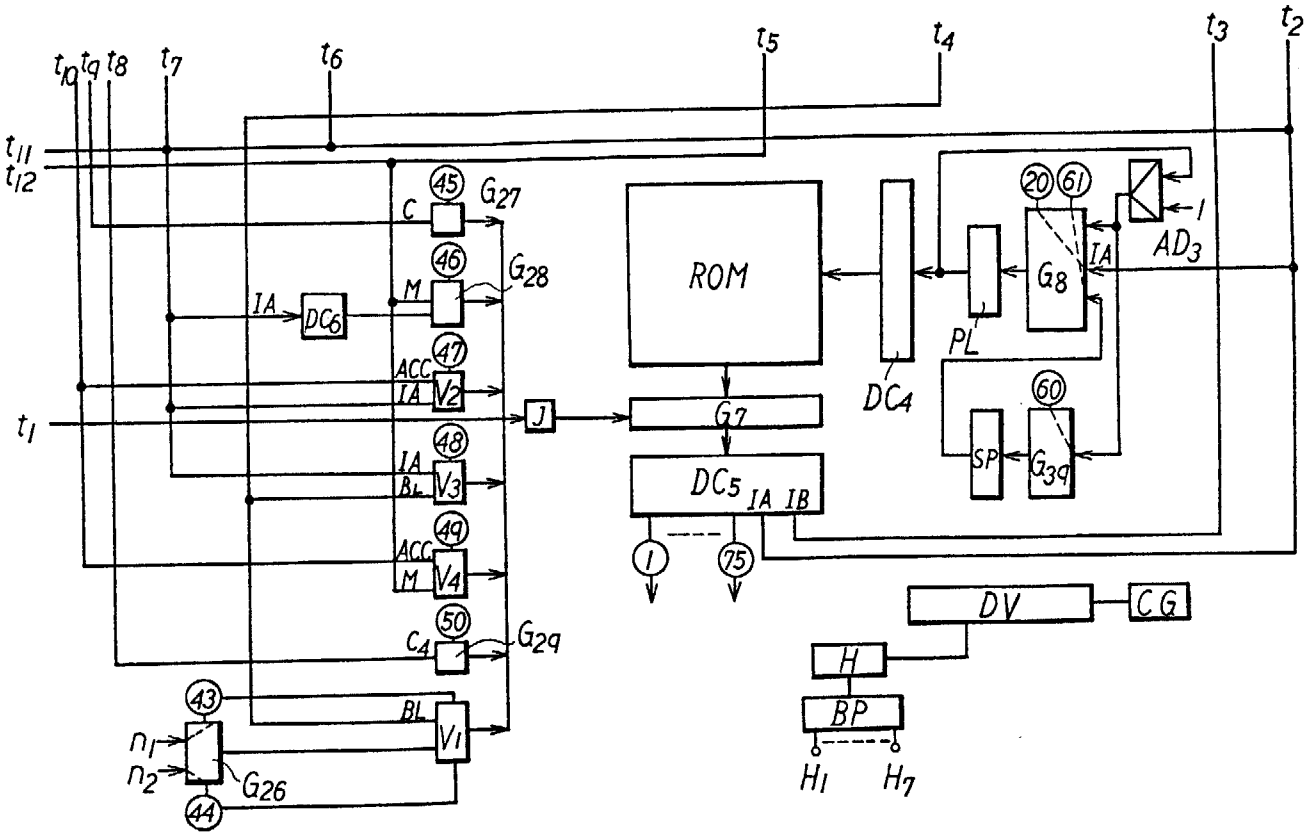
Figure 4C:
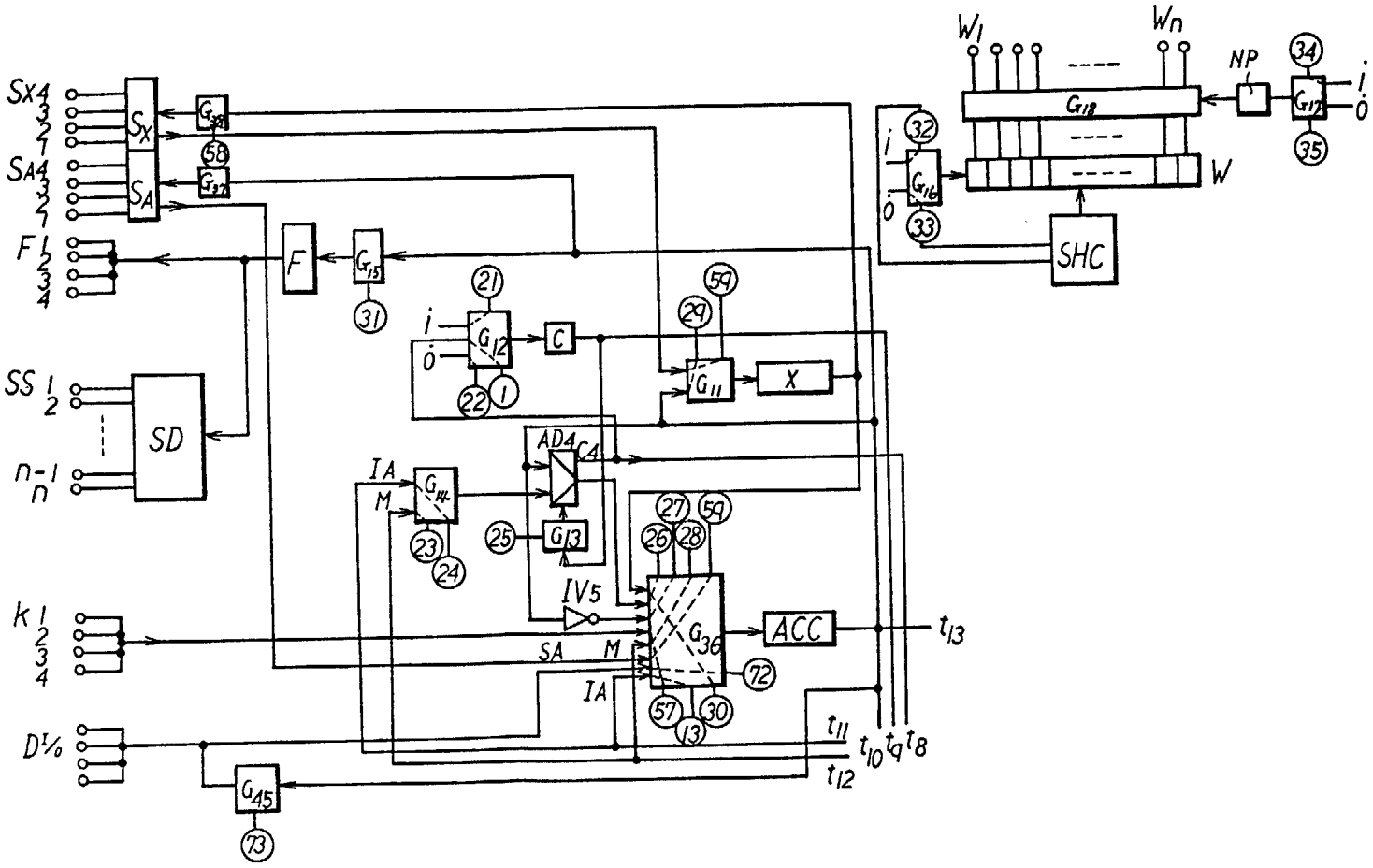
Figure 4D:
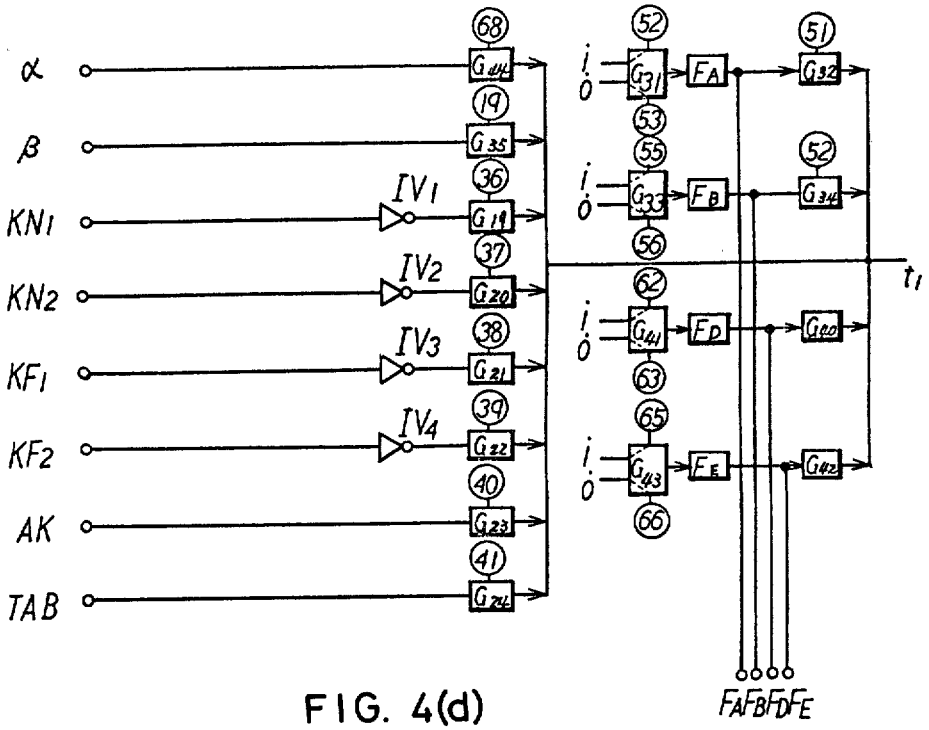

FIG. 2 shows in a block diagram the programmable calculator which includes a central processor unit CPU (hereinafter referred to as "CPU"), the display device DSP, for example, in the form of a liquid crystal display panel of the dot matrix type, display control circuitry DSC for enabling the display device, a random access memory RAM contained within the CPU and a displaying data storage area DRM comprised of a random access memory (RAM) contained within the display control circuitry. It further includes key strobe output terminals $W_1$–$W_8$, key input terminals $k_1$–$k_4$, opposing electrodes signal output terminals $H_1$–$H_7$, a memory digit address output terminal $B_LT$, a memory file address output terminal $B_MT$, a read/write signal terminal R/W, a display (disable) control signal output terminal DIS and data input output terminals DI/O.

Figure 3:
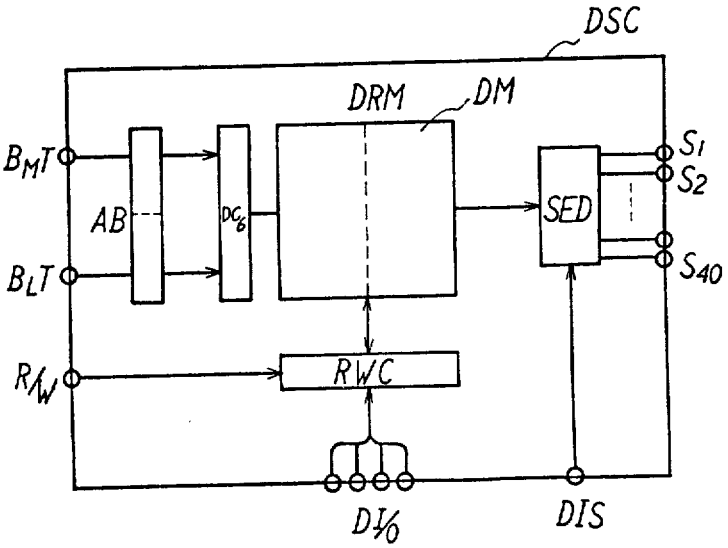
FIG. 3 is a schematic block diagram of display control circuitry DSC in the illustrated calculator.
Figure 5:
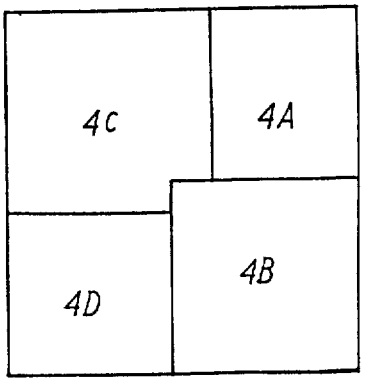
FIG. 5 is a composite diagram of the CPU in the illustrated calculator.

Details of the display control circuitry in FIG. 2 are illustrated in a block diagram of FIG. 3. Within the display control circuitry illustrated herein, an address decoder $DC_6$ is connected to the displaying data storage area DRM, which decoder decodes signals from the memory digit address output terminal $B_L$ and the memory file address output terminal $B_M$ via an address buffer AB. A read/write control circuit RWC receives a read/write signal from the R/W terminal and achieves read and write operations on the information in the displaying data storage area via the data input output terminals DI/O. There are also provided a displaying buffer DM and a segment driver SED for decoding the area DM. When the display disable signal terminal is at "1" or "0", SED provides an ON or OFF waveform output, respectively. Segment signal output terminals are labeled $S_1$–$S_{40}$. FIG. 4, a composite diagram of FIGS. 4A through 4D, shows a logic wiring diagram of the CPU scheme in the calculator whereby the display operation of the present invention is effected. FIG. 5 shows how to combine FIGS. 4A–4D concerning the CPU. The following will set forth a logic structure of the CPU.

[CPU ARCHITECTURE]

RAM (random access memory): this is of a 4 bit input and output capacity and accessible to a specific digit position thereof as identified by a digit address and a file address.

BL: a digit address counter associated with the memory RAM, with an output terminal $B_LT$.

$DC_1$: a digit address decoder associated with the memory RAM.

BM: a file address counter associated with the memory RAM, will an output terminal $B_MT$.

$DC_2$: a file address decoder for the memory RAM $AD_1$: this serves as an adder and a subtractor respectively in the absence and presence of a control instruction (14).

$AD_2$: an adder $G_1$: a gate for providing either a digit "1" or an operand $I_A$ to an input to the adder/subtractor $AD_1$ and delivering I or $I_A$ when a control instruction (15) or (16) is developed, respectively.

SB: a count down circuit for the memory digit address counter BL.

$G_2$: an input gate provided for the memory digit address counter BL, which enables the output of the adder/subtractor $AD_1$, the operand $I_A$, another operand $I_B$ and the output of the count down circuit SB to pass therethrough respectively when control instructions (10), (11), (12) and (74) are developed.

$G_3$: a gate provides a digit "1" or the operand $I_A$ to an input to the adder/subtractor, the former being provided upon the developed of an instruction (5) and the latter upon the development of an instruction (6).

ED: an exclusive OR gate receiving the contents of the memory file address counter BM and the accumulator ACC and providing its output for a gate $G_4$.

$G_4$: an input gate to the memory file address BM which enables the output of the adder $AD_2$, the operand $I_A$ the contents of an accumulator ACC, and the output of EO to pass upon the development of instructions (7), (8), (9) and (85).

$G_5$: a file selection gate for the memory RAM $DC_3$: a decoder which translates the operand $I_A$ and supplies a gate $G_6$ with a desired bit specifying signal.

$G_6$: an input gate to the memory RAM, which contains a circuit arrangement for introducing a binary code "1" into a specific bit position of the memory identified by the operand decoder $DC_3$ and a binary code "D" into a specific bit position identified by $DC_3$, respectively, when a control instruction (2) or (3) is developed. Upon the development of an instruction 11 (4) the contents of the accumulator ACC are read out.

ROM: a read only memory $N_1$, $N_2$: display controlling flags $G_{46}$: an input gate to $N_1$ and $N_2$, which is turned ON upon 69.

RW: a read/write signal generator with its output terminal R/W, whcich executes read or write operation upon (70) or (71), respectively.

PL: a program counter PL which specifies a desired step in the read only memory ROM.

$DC_4$: a step access decoder for the read only memory ROM.

$G_7$: an output gate which shuts off transmission of the output of the ROM to an instruction decoder $DC_5$ when a judge flip flop F/F J is set.

$DC_5$: an instruction decoder adapted to decode instruction codes derived from the ROM and divide them into an operation code area $I_O$ and operand areas $I_A$ and $I_B$, the operation code being decoded into any control instruction (1) - (75). The decoder $DC_5$ is further adapted to output the operand $I_A$ or $I_B$ as it is when sensing an operation doce accompanied by an operand.

$AD_3$: an adder increments one the contents of the program counter PL.

$G_8$: an input gate associated with the program counter PL provides the operand $I_A$ and transmits the contents of a program stack register SP when the instructions (20) and (61) are developed, respectively. When the instructions (20), (61) and (60) are being processed, any output of the adder $AD_3$ is not transmitted. Otherwise the $AD_3$ output is transmitted to automatically load "1" into the contents of the program counter PL.

FC: a flag F/F $G_9$: an input gate for the flag F/F FC, which introduces binary codes "1" and "0" into the flag flip flop FC when the instructions (17) and (18) are developed, respectively.

$G_{10}$: a key signal generating gate provides the output of the memory digit address decoder $DC_1$ without any change when the flag F/F FC is in the reset state (0), and renders all outputs $I_1$-$I_n$ "1" whatever output $DC_1$ provides when FC is in the set state (1).

CG: a clock generator

BP: an opposing electrode signal generator for the liquid crystal display panel $H_1$-$H_7$: The opposing electrode signal output terminals ACC: an accumulator of 4 bits long X: a temporary register of 4 bits long $G_{11}$: an input gate for the temporary register X transmits the contents of the accumulator ACC and the stack register SX respectively upon the development of the instructions (29) and (59).

$AD_4$: an adder executes a binary addition on the contents of the accumulator ACC and other data. The output $C_4$ of the adder $AD_4$ assumes "1" when the fourth bit binary addition yields a carry.

C: a carry F/F $G_{12}$: an input gate for the carry F/F, which sets "1" into the carry F/F C in the presence of "1" of the fourth bit carry $C_4$ and "0" into the same in the absence of $C_4(0)$ upon the development of (1). "1" and "0" are set into C upon the development of (21) and (22), respectively.

$G_{13}$: a carry (C) input gate enables the adder $AD_4$ to perform binary additions with a carry and thus transmits the output of the carry F/F C into the adder $AD_4$ in response to the instruction 25.

$G_{14}$: an input gate provided for the adder $AD_4$ and transfers the output of the memory RAM and the operand $I_A$ upon the development of (23) and (24), respectively.

F: an output buffer register having a 4-bit capacity.

$G_{15}$: an input gate which enables the contents of the accumulator ACC to enter into F upon the development of (31).

SD: an output decoder decodes the contents of the output buffer F into display segment signals $SS_1$-$SS_n$.

W: an output buffer register

SHC: a shift circuit for the output buffer register, which shifts the overall bit contents of the output buffer register W one bit to the right at a time in response to (32) or (33).

$G_{16}$: an input gate for the output buffer register W leads "1" and "0" into the first bit position of W upon (32) and (33), respectively. Immediately before "1" or "0" enters into the first bit position of W the output buffer shift circuit SHC becomes operative.

NP: an output control flag F/F.

$G_{17}$: an input gate to the output control flag F/F for receiving "1" and "0" upon the development of (34) and (35), respectively.

$G_{18}$: an output control gate provided for the buffer register W for providing the respective bit outputs thereof at one time only when the flag F/F NP is in the set state (1). The output signals of the W register are used as the key strobe signals.

J: a judge F/F $IV_1$-$IV_4$: inverter circuits $G_{19}$: an input gate for the judge F/F J for transferring the state of an input $KN_1$ into J upon the development of (36). In the case where $KN_1=0$, $J=1$ because of intervention of the inverter $IV_1$.

$G_{20}$: an input gate for the judge F/F J adapted to transfer the state of an input $KN_2$ into J upon (37). When $KN_2=0$, $J=1$ because of intervention of the inverter $IV_2$.

$G_{21}$: an input gate for the judge F/F J adapted to transfer the state of an input $KF_1$ into J upon (38). When $KF_1=0$, $J=1$ because of the inverter $IV_3$.

$G_{22}$: an input gate for the judge F/F J adapted to transfer the state of the input $KF_2$ into J upon (39). When $KF_2=0$, $J=1$ because of the intervening inverter $IV_4$.

$G_{23}$: an input gate provided for the judge flip flop J for transmission of the state of an input AK into J upon the development of (40). When $AK=1$, $J=1$.

$G_{24}$: an input gate $G_{24}$ is provided for the judge flip flop J to transmit the state of an input TAB into J pursuant to (41). When $TAB=1$, $J=1$.

$G_{25}$: a gate provided for setting the judge F/F J upon the development of (46).

$V_1$: a comparator compares the contents of the memory digit address counter BL with preselected data and provides an output "1" if there is agreement. The comparator $V_1$ becomes operative when (43) or (44) is developed.

$G_{26}$: an input gate to the comparator $V_1$. The data $n_1$ to be compared is a specific higher address value which is often available in controlling the RAM. $n_1$ and $n_2$ are provided for comparison purposes upon the development of (43) and (44), respectively.

$G_{27}$: an input gate provided for the decision F/F J to enter "1" into J when the carry F/F C assumes "1" upon the development of (45).

$DC_6$: a decoder decodes the operand $I_A$ and helps decisions as to whether or not the contents of a desired bit position of the RAM are "1".

$G_{28}$: a gate transfers the contents of the RAM as specified by the operand decoder $DC_6$ into the judge F/F when (46) is derived. When the specified bit position of the RAM assumes "1", $J=1$.

$V_2$: a comparator decides whether or not the contents of the accumulator ACC are equal to the operand $I_A$ and provides an output "1" when the affirmative answer is provided. The comparator $V_2$ becomes operative according to (47).

$V_3$: a comparator decides under (48) whether the contents of the memory digit address counter BL are equal to the operand $I_A$ and provides an output "1" when the affirmative answer is obtained.

$V_4$: a comparator decides whether the contents of the accumulator ACC agree with the contents of the RAM and provides an output "1" in the presence of the agreement.

$G_{29}$: a gate which transfers the fourth bit carry $C_4$ occurring during addition into the judge F/F J. Upon the development of 50 $C_4$ is sent to F/F J. $J=1$ in the presence of $C_4$.

$F_A$: a flag F/F $G_{31}$: an input gate to the flag F/F FA which provides outputs "1" and "0" upon the development of (52) and (53), respectively.

$G_{32}$: an input gate provided for setting the judge F/F J when the flag flip flop FA assumes "1".

$F_B$: a flag F/F $G_{33}$: an input gate for the flag F/F, which provides outputs "1" and "0" upon (55) and (56), respectively.

$G_{34}$: an input gate for the judge flip flop J is adapted to transfer the contents of the flag flip flop $F_B$ into the F/F J upon the development of (52).

$G_{44}$: an input gate to the judge F/F J to transfer the contents of the input under control of (68). $J=1$ when $\alpha=1$.

$G_{35}$: an input gate associated with the judge F/F J is provided for transmission of the contents of an input $\beta$ upon (19). When $\beta=1$, $J=1$.

$G_{45}$: a gate to transfer the contents of the accumulator ACC into the input output terminal $D_{I/O}$ of the displaying data storage area DRM upon receipt of (73).

$G_{36}$: an input gate associated with the accumulator ACC is provided for transferring the output of the adder $AD_4$ upon (26) and transferring the contents of the accumulator ACC after being inverted by an inverter $IV_5$ upon (27). The contents of the memory RAM are transferred upon (28), the operand $I_A$ upon (13), the 4 bit input contents $k_1$-$k_4$ upon (57), and the contents of the stack register SA upon (59). The data from the storage area DRM are fed via $D_{I/O}$ upon (72).

$IV_5$: an inverter circuit

SA: a stack register provides the output outside the present system.

SX: a stack register which also provides the output outside the system.

$G_{37}$: an input gate associated with the stack register SA transfers the accumulator ACC upon (58).

$G_{38}$: an input gate associated with the stack register SX transfers the contents of the temporary register X upon (58).

SP: a program stack register $G_{39}$: an input gate associated with the program stack register for loading the contents of the program counter PL incremented by "1" through the adder into the program stack register upon (60).

An illustrative example of the instruction codes contained within the ROM of the CPU structure, the name and function of the instruction codes and the control instructions developed pursuant to the instruction codes will now be tabulated in Table 1 wherein the following correspondences exist A: the instruction codes, B: the instruction name, C: the instruction description and D: the CPU control instructions.

TABLE 1

| | A | | | B | D |
|---|---|---|---|---|---|
| 1 | | $I_O$ | | SKIP | 42 |
| 2 | | $I_O$ | | AD | 23. 26 |
| 3 | | $I_O$ | | ADC | 23. 26. 25. 1 |
| 4 | | $I_O$ | | ADCSK | 23. 26. 25. 50. 1 |
| 5 | $I_O$ | | $I_A$ | ADI | 24. 26. 50 |
| 6 | $I_O$ | | $I_A$ | DC | 24. 26. 50 |
| 7 | | $I_O$ | | SC | 21 |
| 8 | | $I_O$ | | RC | 22 |
| 9 | $I_O$ | | $I_A$ | SM | 2 |
| 10 | $I_O$ | | $I_A$ | RM | 3 |
| 11 | | $I_O$ | | COMA | 27 |
| 12 | $I_O$ | | $I_A$ | LDI | 13 |
| 13 | $I_O$ | | $I_A$ | L | 28. 8 |
| 14 | $I_O$ | | $I_A$ | LI | 28. 8. 15. 10. 43 |
| 15 | $I_O$ | | $I_A$ | XD | 28. 8. 14. 15. 10. 44 |
| 16 | $I_O$ | | $I_A$ | X | 28. 4. 8 |
| 17 | $I_O$ | | $I_A$ | XI | 28. 4. 8. 15. 10. 43 |
| 18 | $I_O$ | | $I_A$ | XD | 28. 4. 8. 14. 15. 10. 44 |
| 19 | $I_O$ | | $I_A$ | LBLI | 11 |
| 20 | $I_O$ | $I_A$ | $I_B$ | LB | 8. 12 |
| 21 | $I_O$ | | $I_A$ | ABLI | 16. 10. 43 |
| 22 | $I_O$ | | $I_A$ | ABMI | 6. 7 |
| 23 | $I_O$ | | $I_A$ | T | 20 |
| 24 | | $I_O$ | | SKC | 45 |
| 25 | $I_O$ | | $I_A$ | SKM | 46 |
| 26 | $I_O$ | | $I_A$ | SKBI | 48 |
| 27 | $I_O$ | | $I_A$ | SKAI | 47 |
| 28 | | $I_O$ | | SKAM | 49 |
| 29 | | $I_O$ | | $SKN_1$ | 36 |
| 30 | | $I_O$ | | $SKN_2$ | 37 |
| 31 | | $I_O$ | | $SKF_1$ | 38 |
| 32 | | $I_O$ | | $SKF_2$ | 39 |
| 33 | | $I_O$ | | SKAK | 40 |
| 34 | | $I_O$ | | SKTAB | 41 |
| 35 | | $I_O$ | | SKFA | 51 |
| 36 | | $I_O$ | | SKEB | 54 |
| 37 | | $I_O$ | | WIS | 32 |
| 38 | | $I_O$ | | WIR | 33 |
| 39 | | $I_O$ | | NPS | 34 |
| 40 | | $I_O$ | | NPR | 35 |
| 41 | | $I_O$ | | ATF | 31 |
| 42 | | $I_O$ | | LXA | 29 |
| 43 | | $I_O$ | | XAX | 29. 30 |
| 44 | | $I_O$ | | SFA | 52 |
| 45 | | $I_O$ | | RFA | 53 |
| 46 | | $I_O$ | | SFB | 55 |
| 47 | | $I_O$ | | RFB | 56 |
| 48 | | $I_O$ | | SFC | 17 |
| 49 | | $I_O$ | | RFC | 18 |
| 50 | | $I_O$ | | SFD | 62 |
| 51 | | $I_O$ | | RFD | 63 |
| 52 | | $I_O$ | | SFE | 65 |
| 53 | | $I_O$ | | RFE | 66 |
| 54 | | $I_O$ | | SKA | 68 |
| 55 | | $I_O$ | | SKB | 19 |
| 56 | | $I_O$ | | KTA | 57 |
| 57 | | $I_O$ | | STPO | 58 |
| 58 | | $I_O$ | | EXPO | 58. 59 |
| 59 | $I_O$ | | $I_A$ | TML | 62. 20 |
| 60 | | $I_O$ | | RIT | 61 |
| 61 | $I_O$ | $I_A$ | $I_B$ | LNI | 69 |
| 62 | | $I_O$ | | READ | 70. 72 |
| 63 | | $I_O$ | | STOR | 71. 73 |
| 64 | $I_O$ | | $I_A$ | EX | 28. 4. 75. 16 |
| 65 | | $I_O$ | | DECB | 74 |

Instruction Description (C)

(1) SKIP

Only the program counter PL is incremented without executing a next program step instruction, thus skipping a program step.

(2) AD

A binary addition is effected on the contents of the accumulator ACC and the contents of the RAM, the addition results being loaded back into the accumulator ACC.

(3) ADC

A binary addition is effected on the contents of the accumulator ACC, the memory RAM and the carry F/F C, the results being loaded back to the accumulator ACC.

(4) ADCSK

A binary addition is effected on the contents of the accumulator ACC, the memory RAM and the carry flip flop C, the results being loaded into the accumulator ACC. If the fourth bit carry $C_4$ occurs in the results, then a next program step is skipped.

(5) ADI

A binary addition is effected upon the contents of the accumulator ACC and the operand $I_A$ and the results are loaded into the accumulator ACC. If the fourth bit carry $C_4$ is developed in the addition results, then a next program step is skipped.

(6) DC

The operand $I_A$ is fixed as "1010" (a decimal number "10") and a binary addition is effected on the contents of the accumulator ACC and the operand $I_A$ in the same way as in the ADI instruction. The decimal number 10 is added to the contents of the accumulator ACC, the results of the addition being loaded into ACC.

(7) SC

The carry F/F C is set ("1" enters into C).

(8) RC

The carry F/F C is reset ("0" enters into C).

(9) SM

The contents of the operand $I_A$ are decoded to give access to a desired bit position of the memroy specified by the operand ("1" enters).

(10) RM

The contents of the operand $I_A$ are interpreted to reset a desired bit position of the memory specified by the operand ("0" enters).

(11) COMA

The respective bits of the accumulator ACC are inverted and the resulting complement to "15" is introduced into ACC.

(12) LDI

The operand $I_A$ enters into the accumulator ACC.

(13) L

The contents of the memory RAM are sent to the accumulator ACC and the operand $I_A$ to the file address counter BM.

(14) LI

The contents of the memory RAM are sent to the accumulator ACC and the operand $I_A$ to the memory file address counter BM. At this time the memory digit address counter BL is incremented. If the contents of BL agree with the preselected value $n_1$, then a next program step is skipped.

(15) XD

The contents of the memory RAM are exchanged with the contents of ACC and the operand $I_A$ is sent to the memory file address counter BM. The memory digit address counter BL is decremented. In the event that the contents of BL agree with the preselected value $n_2$, then a next program step is skipped.

(16) X

The contents of the memory RAM are exchanged with the contents of the accumulator ACC and the operand $I_A$ is loaded into the memory file address counter BM.

(17) XI

The contents of the memory RAM are exchanged with the contents of the accumulator ACC and the operand $I_A$ is sent to the memory file address counter BM. The memory digit address counter BL is incremented. In the event that BL is equal to the preselected value $n_1$, a next program step is skipped.

(18) XD

The contents of the memory RAM replaces the contents of the accumulator ACC, the operand $I_A$ being sent to the memory file address counter BM. The memory digit address counter BL at this time is incremented. If the contents of BL are equal to $n_2$, then a next program step is skipped.

(19) LBLI

The operand $I_A$ is loaded into the memory digit address counter BL.

(20) LB

The operand $I_A$ is loaded into the memory file address counter BM and the operand B to the memory digit address counter BL.

(21) ABLI

The operand $I_A$ is added to the contents of the memory digit address counter BL in a binary addition fashion, the results being loaded back to BL. If the contents of BL are equal to $n_1$, then no next program step is carried out.

(22) ABMI

The operand $I_A$ is added to the contents of the memory file address counter BM in a binary fashion, the results being loaded into BM.

(23) T

The operand $I_A$ is loaded into the program step counter PL.

(24) SKC

If the carry flip flop C is "1", then no next program step is taken.

(25) SKM

The contents of the operand $I_A$ are decoded and a next program step is skipped as long as a specific bit position of the memory specified by the operand $I_A$ assumes "1".

(26) SKBI

The contents of the memory digit address counter BL are compared with the operand $I_A$ and a next succeeding program step is skipped when there is agreement.

(27) SKAI

The contents of the accumulator ACC are compared with the operand $I_A$ and if both are equal to each other a next program step is skipped.

(28) SKAM

The contents of the accumulator ACC are compared with the contents of the RAM and if both are equal a next program step is skipped.

(29) $SKN_1$

When the input $KN_1$ is "0", a next program step is skipped.

(30) $SKN_2$

When the input $KN_2$ is "0", a next program step is skipped.

(31) $SKF_1$

When the input $KF_1$ is "0", a next program step is skipped.

(32) $SKF_2$

When the input $KF_2$ is "0", a next program step is skipped.

(33) SKAK

When the input AK is "1", a next program step is skipped.

(34) SKTAB

When the input TAB is "1", a next program step is skipped.

(35) SKFA

When the flag flip flop F/A assumes "1" a next program step is skipped.

(36) SKFB

When the flag flip flop $F_B$ assumes "1", a next program step is skipped.

(37) WIS

The contents of the output buffer register W are one bit right shifted, the first bit position (the most significant bit position) receiving "1".

(38) WIR

The contents of the output buffer register W are one bit right shifted, the first bit position (the most significant bit position being loaded with "0".

(39) NPS

The output control F/F $N_p$ for the buffer register W is set ("1" enters).

(40) NPR

The buffer register output control flip flop $N_p$ is reset ("0" enters therein).

(41) ATF

The contents of the accumulator ACC are transferred into the output buffer register F.

(42) LXA

The contents of the accumulator ACC are unloaded into the temporary register X.

(43) XAX

The contents of the accumulator ACC are exchanged with the contents of the temporary register X.

(44) SFA

The flag F/F FA is set (an input of "1").

(45) RFA

The flag F/F FA is reset (an input of "0").

(46) SFB

The flag flip flop $F_B$ is set (an input of "1").

(47) RFB

The flag flip flop $F_B$ is reset (an input of "0").

(48) SFC

An input testing flag F/F $F_C$ is set (an input of "1").

(49) RFC

The input testing flag F/F $F_C$ is reset (an input of "0").

(50) SFC

The input testing flag F/F $F_D$ is set (an input of "1").

(51) RFD

The input testing flag F/F $F_D$ is reset (an input of "0").

(52) SFE

The input testing flag F/F $F_E$ is set (an input of "1").

(53) RFE

The input testing flag F/F $F_E$ is set (an input of "1").

(54) SKA

When an input $\alpha$ is "1", a next program step is skipped.

(55) SKB

When an input $\beta$ is "1", a next program step is skipped.

(56) KTA

The inputs $k_1$–$k_4$ are introduced into the accumulator ACC.

(57) STPO

The contents of the accumulator ACC are sent to the stack register SA and the contents of the temporary register X to the stack register SX.

(58) EXPO

The contents of the accumulator ACC are exchanged with the stack register SA and the contents of the temporary register X with the stack register SX.

(59) TML

The contents of the program counter $P_L$ incremented by one are transferred into the program stack register SP and the operand $I_A$ into the program counter $P_L$.

(60) RIT

The contents of the program stack register SP are transmitted into the program counter $P_L$.

Table 2 sets forth the relationship between the operation codes contained within the ROM of the CPU structure and the operand.

TABLE 2

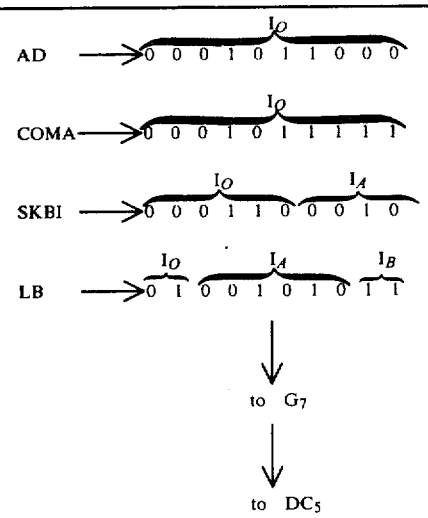

wherein $I_O$: the operation codes and $I_A$, $I_B$: the operands

Taking an example wherein the output of the read only memory ROM is 10 bit long, the instructoin decoder $DC_5$ decides whether the instruction AD or COMA (see TAble 1) assumes "0001011000" or "0001011111" and develops the control instructions (23), (26), or (27). SKBI is identified by the fact that the upper six bits assume "000110", the lower 4 bits "0010" being treated as the operand $I_A$ and the remaining ninth and tenth bits "11" as the operand $I_B$. The operand forms part of instruction words and specifies data and addresses for next succeeding instructions and can be called an address area of an instruction.

Major processing operaitons (a processing list) of the CPU structure will now be described in sufficient detail.

[PROCESSING LIST]

(I) A same numeral N is loaded into a specific region of the memory RAM (NNN→X)

(II) A predetermined number of different numerals are loaded into a specific region of the memory ($N_1$, $N_2$, $N_3$, . . . →X)

(III) The contents of a specific region of the memory are transferred into a different region of the memory (X→Y)

(IV) The contents of a specific region of the memory are exchanged with that of a different region (X←→Y)

(V) A given numeral N is added or subtracted in a binary fashion from the contents of a specific region of the memory (X±N)

(VI) The contents of a specific region of the memory are added in a decimal fashion to the contents of a different region (X±Y)

(VII) The contents of a specific region of the memory are one digit shifted (X right, X left).

(VIII) A one bit conditional F/F associated with a specific region of the memory is set or reset (F set, F reset)

(IX) The state of the one bit conditional F/F associated with a specific region of the memory is sensed and a next succeeding program address is changed according to the results of the state detection.

(X) It is decided whether the digit contents of a specific region of the memory reach a preselected numeral and a next succeeding program step is altered according to the results of such decision.

(XI) It is decided whether the plural digit contents of a specific region of the memory are equal to a preselected numeral and a program step is altered according to the results of the decision.

(XII) It is decided whether the digit contents of a specific region of the memory are smaller than a given value and a program step to be next executed is changed according to the decision.

(XIII) It is decided whether the contents of a specific region of the memory are greater than a given value and the results of such decision alter a program step to be next executed.

(XIV) The contents of a specific region of the memory are displayed.

(XV) What kind of a key switch is actuated is decided.

The above processing events in (1)-(15) above are executed according to the instruction codes step by step in the following manner.

(I) PROCEDURE OF LOADING A SAME VALUE N INTO A SPECIFIC REGION OF THE MEMORY (NNN→X)

(Type 1)

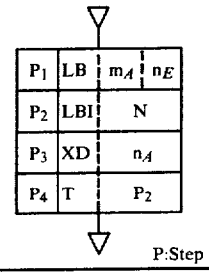

$P_1$ . . . The first digit position of the memory to be processed is specified by a file address $m_A$ and a digit address $n_E$.

$P_2$ . . . The value N is loaded into ACC.

$P_3$ . . . The value N is loaded into the specified region of the memory by exchange between the memory and ACC. With no change in the file address of the memory, $m_A$ is specified and the digit address is decremented to determine a digit to be next introduced. By determing $n_2$ as the final digit value $n_A$ to be introduced, the next step $P_4$ is skipped to complete the processing of the Type 1 since $BL=n_2$ under the condition that the value N has been completely loaded into the specific region.

$P_4$ . . . LDI and XD are carried out repeatedly from the program address $P_2$ up to BL=V.

(Type 2)

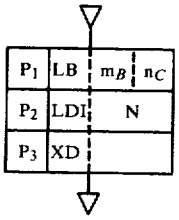

$P_1$ . . . The digit of the memory to be processed is determined by the file address $m_B$ and the digit address $n_C$.

$P_2$ . . . The ACC is loaded with the value N.

$P_3$ . . . By exchange between the memory and ACC the value N is loaded into the above specified region of the memory. This completes the processing of Type 2. An operand area of $X_D$ is necessary to the next succeeding proce-s and not to this step.

(Type 3)

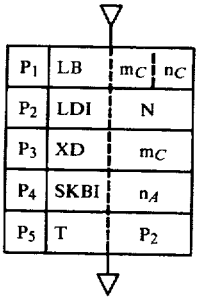

$P_1$ . . . The first digit of the memory to be processed is specified by the file address $m_C$ and the digit address $n_O$.

$P_2$ . . . The ACC is loaded with the value N.

$P_3$ . . . By exchange between the memory and ACC the value N is loaded into that specified region of the memory. With no change in the file address of the memory $m_C$ is specified and the digit address is decremented in order to determine the digit to be next loaded therein.

$P_4$ . . . It is decided whether the digit processed during the step $P_3$ is the final digit $n_B$. If it is $n_B$, then the digit address is decremented to $n_A$. An operand area of the SKI instruction is occupied by $n_A$, thus loading the final digit with the value N. In reaching $P_4$, conditions are fulfilled and the next step $P_5$ is skipped, thereby terminating the type 3. If the conditions are not fulfilled, $P_5$ is then reached.

$P_5$ . . . The program address $P_2$ is specified and $P_2$–$P_4$ are repeated until $BL=n_A$.

(II) PROCEDURE OF LOADING A PREDETERMINED NUMBER OF DIFFERENT VALUES INTO A SPECIFIC REGION OF THE MEMORY ($N_1$, $N_2$, $N_3$, . . . →X)

(Type 1) For example, for digit values $N_4N_3N_2N_1$ are loaded an arbitraray digit position in the same manner as above.

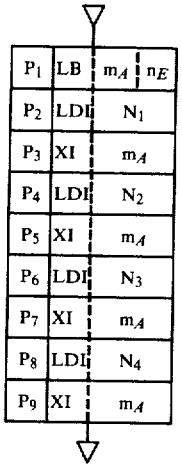

$P_1$ . . . The first processed digit position of the memory is specified by the file address $m_A$ and the digit address $n_E$.

$P_2$ . . . A constant $N_1$ is loaded into ACC.

$P_3$ . . . Through exchange between the memory and the ACC the value $N_1$ is loaded into the above specified region of the memory. The file address of the memory remains unchanged as $m_A$, whereas the digit address is up for introduction of the next digit.

$P_4$ . . . A second constnat $N_2$ is loaded into ACC.

$P_5$ . . . Since the second digit of the memory has been specified during $P_3$, the second constant $N_2$ is loaded into the second digit position of the memory through exchange between the memory and ACC.

$P_6$–$P_9$ . . . The same as in the above paragraph.

(Type 2)

Any value of 0–15 is loaded into a predetermined register.

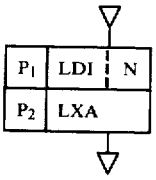

$P_1$ . . . The value N is loaded into ACC.

$P_2$ . . . The value N is transmitted from ACC into the register X.

(III) PROCEDURE OF TRANSFERRING THE CONTENTS OF A SPECIFIC REGION OF THE MEMORY TO A DIFFERENT REGION OF THE MEMORY (X→Y)

(Type 1)

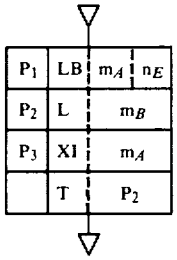

$P_1$ . . . The first memory file address is specified as $m_A$ and the first digit address as $n_E$.

$P_2$ . . . The contents of the first digit position of the memory are loaded into ACC and its designation, the second memory file address is specified as $m_B$ prior to the transmission step $P_3$.

$P_3$ . . . The first digit memory contents loaded into the ACC are replaced by the same second memory digit contents so that the first memory contents are transmitted into the second memory. In order to repeat the above process, the first memory file address $m_A$ is again set. The value of the final digit $n_A$ to be transmitted is previously selected to be $n_1$. Since BL→$n_1$ after the overall first memory contents have been sent to the second memory, the next step $P_4$ is skipped to complete the processing of Type 1. The digit address is progressively incremented until BL=V (the final digit). Through the step $P_4$ the file address is set up at $m_A$ to lead back to $P_2$, thereby specifying the first memory.

$P_4$ . . . The program address is set at the step $P_2$ and the instructions $P_2$ and $P_3$ are repeatedly executed until BL=$n_1$. The transmission step is advanced digit by digit.

(Type 2)

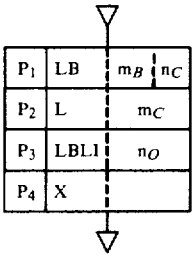

$P_1$ . . . The region of the memory to be processed is determined by the file address $m_A$ and the digit address $n_C$.

$P_2$ . . . The contents of the memory as specified above are unloaded into ACC and the memory file address is set at $m_C$ prior to the next transmission step $P_4$.

$P_3$ . . . The digit address of the memory, the destination for the transmission process, is specified as $m_C$. The destinated region of the memory is specified via the steps $P_2$ and $P_3$.

$P_4$ . . . The contents of ACC are exchanged with the contents of the regions of the memory specified bu $P_2$ and $P_3$. The operand of X has no connection with the present process.

(Type 3)

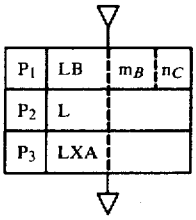

$P_1$ . . . The region of the memory to be processed is identified by the file address $m_A$ and the digit address $n_C$.

$P_2$ . . . The contents of the memory region specified during $P_1$ are unloaded into ACC.

$P_3$ . . . The contents of the memory transmitted from ACC are sent to the register X, completing the type 3 processing.

(IV) PROCEDURE OF EXCHANGING CONTENTS BETWEEN A SPECIFIC REGION OF THE MEMORY AND A DIFFERENT REGION (X→Y)

(Type 1)

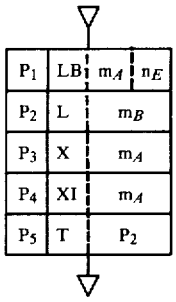

$P_1$ . . . The first memory file address to be processed is specified as $m_A$ and the first digit address as $n_E$.

$P_2$ . . . The specific digit contents of the first memory are loaded into ACC and the second memory file address is specified as $m_B$ for preparation of the next step.

$P_3$ . . . The specific digit contents of the first memory contained within ACC are exchanged with the same digit contents of the second memory specified by $P_2$. The file address of the first memory is specified as $m_A$ in order to load the contents of the memory now in ACC into the first memory.

$P_4$ . . . The contents of the second memory now in ACC are exchanged with the contents of the first memory at the corresponding digit positions so that the contents of the second memory are transferred to the first memory. Exchanges are carried out during the steps $P_2$–$P_4$. The first memory is specified on by the file address $m_A$, while the digit address is incremented to select a next address. Exchange is carried out progressively digit by digit. The final digit value $n_A$ is previously set at $n_1$ such that $B_L = n_1$ after the exchange operation between the first memory and the second has been effected throughout the all digit positions, thus skipping the next step $P_5$ and completing the processing of Type 1.

$P_5$ . . . The program address $P_2$ is selected and the instructions for $P_2$ to $P_4$ are executed repeatedly until $B_L = n_1$. The exchange operation is advanced digit by digit.

(Type 2)

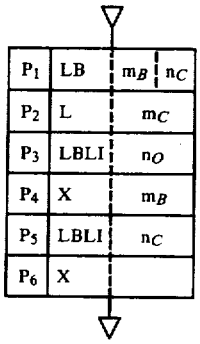

$P_1$ . . . The file address of the first memory to be processed is specified as $m_A$ and the digit address as $n_C$.

$P_2$ . . . The contents of the specific digit position of the first memory are unloaded into ACC and the file address of the second memory is specified as $m_C$ and ready to exchange.

$P_3$ . . . The digit address of the second memory, the destination for the exchange process, is specified as $n_O$ to determine the destinated memory address.

$P_4$ . . . The contents of the first memory now within ACC are exchanged with that of the second memory. At the same time the file address $m_B$ of the first memory is again specified to transfer the contents of the first memory to the first memory.

$P_5$ . . . The digit address $n_C$ of the first memory is specified to determine the destination address of the first memory.

$P_6$ . . . The contents of the second memory now within ACC are exchanged with the contents of the first memory.

(Type 3)

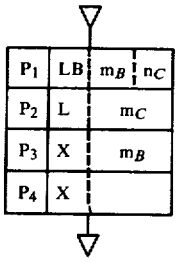

$P_1$ . . . The file address $m_A$ of the first memory to be processed is specified and the digit address $n_C$ is specified.

$P_2$ . . . The contents of the first memory are loaded into ACC and the file address $m_C$ of the second memory is selected.

$P_3$ . . . The exchange is carried out between the first and second memory so that the contents of the first memory are loaded into the second memory. Prior to the step $P_4$ the file address $m_B$ of the first memory is selected again.

$P_4$ . . . The exchange is effected between the contents of the second memory and the first memory.

(Type 4)

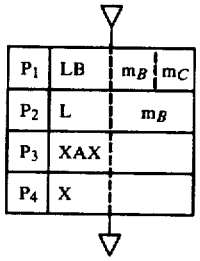

$P_1$ . . . The region of the memory to be processed is specified by the file address $m_A$ and the digit address $n_C$.

$P_2$ . . . The contents of the memory region specified in $P_1$ above are loaded into ACC. The file address $m_B$ is kept being selected prior to the exchange with the contents of the register X.

$P_3$ . . . The exchange is effected between ACC and the register X so that the contents of the memory are shifted to the register X.

$P_4$ . . . Through the exchange between ACC containing the contents of the register X and the memory, the contents of the register X are substantially transferred into the memory, thus accomplishing the Type 4 processing.

(V) PROCEDURE OF EFFECTING A BINARY ADDITION OR SUBTRACTION OF A GIVEN VALUE N ONTO A SPECIFIC REGION OF THE MEMORY (Type 1) $M_1 + N \longrightarrow M$

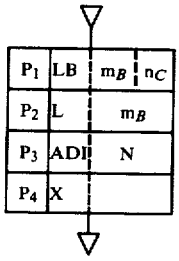

$P_1$ . . . The region of the memory to be processed is specified by the file address $m_B$ and the digit address $n_C$.

$P_2$ . . . The contents of the memory specified by the step $P_1$ are unloaded into ACC. The memory file address is set again at $m_B$ to specify the same memory.

$P_3$ . . . The operand specifies the value N to be added and the contents of the memory contained within ACC are added with the value N, the results being loaded back to ACC.

$P_4$ . . . The sum contained with ACC is exchanged with the contents of the memory specified by the step $P_2$, thus completing the Type 1 processing.

(Type 2) X + N ⟶ X

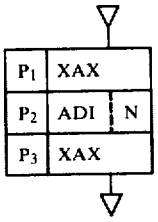

$P_1$ . . . The exchange is effected between the register X and ACC.

$P_2$ . . . The operand specifies the value N to be added and an addition is carried out on the contents of the register X now within ACC and the value N, with the results back to ACC.

$P_3$ . . . Through the exchange between the resulting sum within ACC and the contents of the register X, the processing of Type 2 (X+N→X) is performed.

(Type 3) $M_1$ + N ⟶ $M_2$

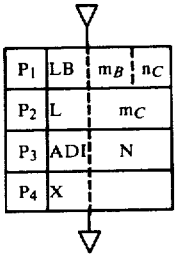

$P_1$ . . . The region of the first memory to be processed is decided by the file address $m_B$ and the digit address $n_C$.

$P_2$ . . . The contents of the memory specified by $P_1$ are loaded into ACC. The file address $m_C$ of the second memory is specified to return addition results to the second memory.

$P_3$ . . . The operand specifies the value N to be added and the value N is added to the contents of the memory now within ACC, with the results being loaded into ACC.

$P_4$ . . . The resulting sum within ACC is exchanged with the contents of the second memory as specified by $P_2$, thus completing the processing of Type 3.

(Type 4) $M_1$ − N ⟶ $M_1$

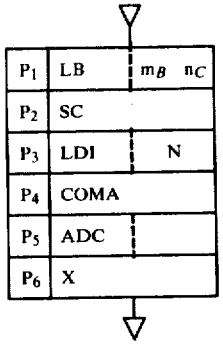

$P_1$ . . . There are specified the file address $m_B$ and the digit address $n_C$ of the memory to be processed.

$P_2$ . . . Subtraction is carried out in such a way that the complement of a subtrahend is added to a minuend and the F/F C remains set because of the absence of a borrow from a lower digit position.

$P_3$ . . . ACC is loaded with the subtrahend N.

$P_4$ . . . The complement of the subtrahend to "15" is evaluated and loaded into ACC.

$P_5$ . . . In the event that any borrow occurs during the subtraction, the complement of the subtrahend to "16" is added to the minuend. If a borrow free state is denoted as C=1, then a straight binary subtraction of $ACC+C+M \rightarrow \overline{ACC}$ is effected.

$P_6$ . . . The resulting difference during $P_5$ is returned to the same memory through the exchange between ACC and that memory.

(Type 5) $M_1$ − N ⟶ $M_2$

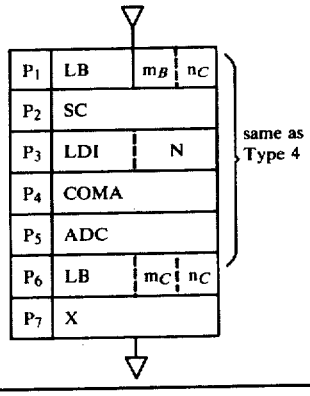

$P_6$ . . . To load the resulting difference during $P_5$ into the second memory, the file address $m_C$ and the digit address $n_C$ of the second memory are selected.

$P_7$ . . . Through exchange the resulting difference is transferred from ACC into the second memory as specified by the step $P_6$.

(Type 6)

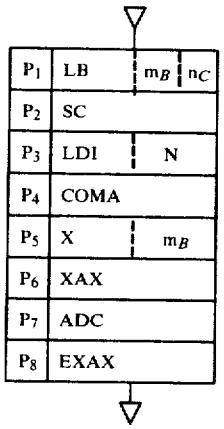

$P_1$ . . . The file address $m_B$ and the digit address $n_C$ of the memory ready for the step $P_5$ are selected.

$P_2$ . . . Subtraction is carried out in the manner of adding the complement of a subtrahend to a minuend and the F/F C remains set because of the absence of a borrow from a lower digit position.

$P_3$ . . . ACC is loaded with the subtrahend N.

$P_4$ . . . The complement of the subtrahend to "15" is evaluated and loaded into ACC.

$P_5$ . . . To accomplish calculations with the contents of the register X, the memory as specified by $P_1$ is loaded with the contents of ACC.

$P_6$ . . . The contents of the register X are transmitted into ACC through the exchange process. After this step the memory contains the complement of the subtrahend to "15" and ACC contains the contents of X.

$P_7$ . . . ACC+M+C corresponds to X−N and the results of a binary subtraction are loaded into ACC.

$P_8$ . . . The contents of ACC are exchanged with the contents of X and the value of X−N is transmitted into X, thereby completing the processing of Type 6.

(Type 7) N − $M_1 \longrightarrow M_1$

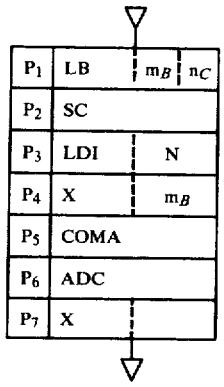

$P_1$ . . . The file address $m_B$ and the digit address $n_C$ of the memory to be processed are selected.

$P_2$ . . . One-digit subtraction is effected in the manner of adding the complement of a subtrahend to a minuend, in which case F/F C remains set.

$P_3$ . . . ACC is loaded with a minuend.

$P_4$ . . . The exchange is effected between the memory (the subtrahend) and ACC and the memory file address remains as $m_B$ for preparation of $P_7$.

$P_5$ . . . The complement of a subtrahend in ACC to "15" is evaluated and loaded into ACC.

$P_6$ . . . In the event that there is no borrow from a lower digit position, the complement of a subtrahend to "16" is added to a minuend. If a borrowless state is denoted as C=1, then N−M is substantially executed by $\overline{ACC}$+C+M, the resulting difference being loaded into ACC.

$P_7$ . . . Since the memory file address remains unchanged during $P_4$, the difference is unloaded from ACC back to the memory, thus completing the processing of Type 7.

(Type 8) N − $M_1 \longrightarrow M_2$

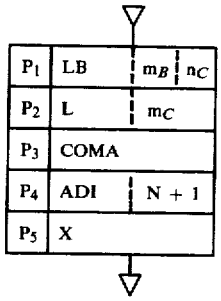

$P_1$ . . . The file address $m_B$ and the digit address $n_C$ of the memory to be processed are selected.

$P_2$ . . . The contents specified by the step $P_1$ and corresponding to a subtrahend are loaded into ACC. The file address $m_C$ of the second memory is specified for preparation of a step $P_5$.

$P_3$ . . . The complement of the subtrahend to "15" is evaluated and loaded into ACC.

$P_4$ . . . The operand is made a minuend plug "1". This subtraction is one digit long and accomplished by adding the complement of the subtrahend to the minuend. A conventional complementary addition is defined as $\overline{ACC}$+C+M as in the Type 7 processing in the absence of a borrow as defined by C=1. Since the ADI instruction carries C, $\overline{ACC}$+1 is processed in advance. This completes the processing of Type 8 of N−M, the results being stored within ACC.

$P_5$ . . . The difference obtained from the step $P_4$ is transmitted into the second memory specified by $P_2$.

(Type 9) M ± 1 ⟶ M

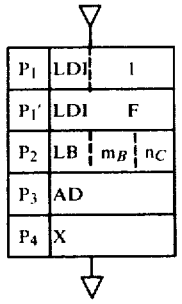

$P_1$ . . . (When M+1) ACC is loaded with a binary number "0001" (=1).

$P_1'$ . . . (When M−1) ACC is loaded with a binary number "1111" (=15).

$P_2$ . . . The file address $m_B$ and the digit address $n_C$ of the memory to be processed are selected.

$P_3$ . . . The contents of the memory specified by $P_2$ are added to the contents contained within ACC during $P_1$ or $P_1'$, the sum thereof being loaded into ACC. In the case of $P_1$ ACC+1 and in the case of $P_1'$ ACC−1.

$P_4$ . . . The results are unloaded from ACC to the original memory position, thus completing the processing fashion of Type 9.

(VI) PROCEDURE OF EFFECTING A DECIMAL ADDITION OR SUBTRACTION BETWEEN A SPECIFIC REGION OF THE MEMORY AND A DIFFERENT REGION (Type 1) X + W ⟶ X

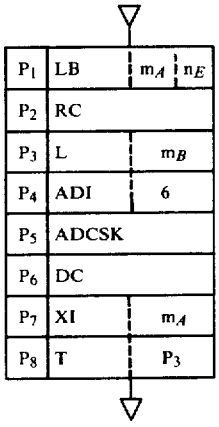

$P_1$ . . . The first digit position of the first memory to be processed is identified by the file address $m_A$ and the digit address $n_E$.

$P_2$ . . . The carry F/F C is reset because of a carry from a lower digit position in effecting a first digit addition.

$P_3$ . . . The contents of the specific digit position of the first memory are loaded into ACC and the file address $m_B$ of the second memory is selected in advance of additions with the contents of the second memory during $P_4$.

$P_4$ . . . "6" is added to the contents of the specific digit position of the first memory now loaded into ACC for the next succeeding step $P_5$ wherein a decimal carry is sensed during addition.

$P_5$ . . . ACC already receives the contents of the first memory compensated with "6" and a straight binary addition is effected upon the contents of ACC and the contents of the second memory at the corresponding digit positions, the results being loaded back to ACC. In the event a carry is developed during the binary addition at the fourth bit position, $P_7$ is reached without passing $P_6$. The presence of the carry during the fourth bit addition implies the development of a decimal carry.

$P_6$ . . . In the event the decimal carry failed to develop during the addition $P_5$, "6" for the process $P_4$ is overruded. An addition of "10" is same as a subtraction of "6".

$P_7$ . . . The one-digit decimal sum is unloaded from ACC into the second memory and the digit address is incremented for a next digit addition and the file address $m_A$ of the first memory is selected. The final digit to be added is previously set at $n_1$. Since $BL=n_1$ after the overall digit addition is effected upon the first and second memory, the next succeeding step $P_8$ is skipped to thereby complete the processing of Type 1.

$P_8$ . . . The program address $P_3$ is selected and the instructions $P_3$–$P_7$ are repeatedly executed until $BL=n_1$. A decimal addition is effected digit by digit.

(Type 2) X − W ⟶ X

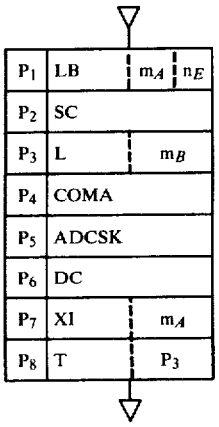

$P_1$ . . . The first digit position of the first memory to be processed is specified by the file address $m_A$ and the digit address $n_E$.

$P_2$ . . . Subtraction is performed in the manner of adding the complement of a subtrahend to a minuend and F/F C is set because of the absence of a borrow from a lower digit position during the first digit subtraction.

$P_3$ . . . The contents of the specific digits in the first memory, the subtrahend, are loaded into ACC and the file address $m_B$ of the second memory is specified in advance of the step $P_7$ with the second memory.

$P_4$ . . . The complement of the subtrahend to "15" is evaluated and loaded into ACC.

$P_5$ . . . In the event that there is no borrow from a lower digit place, the complement of the subtrahend is added to the minuend to perform a subtraction. On the contrary, in the presence of a borrow, the complement of the subtrahend is added to the minuend. If a borrowless state is denoted as C=1, then a binary addition of $\overline{ACC}+C+M \rightarrow ACC$ is effected. The development of a carry, as a consequence of the execution of the ADSCK instruction, implies failure to give rise to a borrow and leads to the step $P_7$ without the intervention of the step $P_6$. Under these circumstances the addition is executed with the second memory, thus executing substantially subtraction between the first and second memories.

$P_6$ . . . In the case where no carry is developed during the execution of the ADCSK instruction by the step $P_5$, the calculation results are of the sexadecimal notation and thus converted into a decimal code by subtraction of "6" (equal to addition of "10").

$P_7$ . . . The resulting difference between the first and second memories is transmitted from ACC into the second memory. The digit address is incremented and the file address $m_A$ of the first memory is specified in advance of a next succeeding digit subtraction. The final digit to be subtracted is previously determined as $n_1$. Since $BL=n_1$ after the overall-digit subtraction has been completed, the next step $P_8$ is skipped to thereby conclude the processing of Type 2.

$P_8$ . . . After selection of the program address $P_3$ the instructions $P_3$–$P_7$ are repeatedly executed until $BL=n_1$. The decimal subtraction is advanced digit by digit.

(VII) PROCEDURE OF SHIFTING ONE DIGIT THE CONTENTS OF A SPECIFIC REGION OF THE MEMORY (Type 1) Right Shift

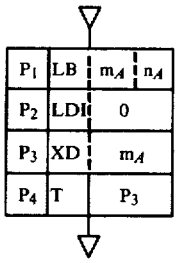

$P_1$ . . . The file address $m_A$ and the digit address $n_A$ of the memory to be processed are determined.

$P_2$ . . . ACC is loaded with "0" and ready to introduce "0" into the most significant digit position when the right shift operation is effected.

$P_3$ . . . The exchange is carried out between XCC and the memory and the digit address is decremented to specific a one digit lower position. The memory address is still at $m_A$. XD is repeated executed through $P_4$ and $P_3$. By the step ACC⟷M "0" is transmitted from ACC to the most significant digit position of the memory which in turn provides its original contents for ACC. When the digit address is down via B and XD is about to be executed at $P_3$ via $P_4$, the second most significant digit is selected to contain the original content of the most significant digit position which has previously been contained within ACC. At this time ACC is allowed to contain the contents of the second most significant digit position. The least significant digit is previously selected as $n_2$. If the transmission step reaches the least significant digit position $BL=n_2$ is satisfied and $P_4$ is skipped. In other words, the digit contents are shifted down to thereby conclude the processing of Type 1.

$P_4$ . . . XD is repeated at $P_3$ until BL=V.

(Type 2) Left Shift

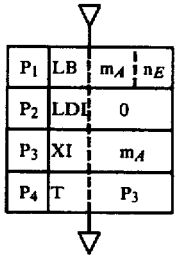

$P_1$ . . . The file address $m_A$ and the least significant digit $n_E$ of the memory to be processed are determined.

$P_2$ . . . ACC is loaded with "0" and ready to introduce "0" into the least significant digit position when the left shift operation is started.

$P_3$ . . . The exchange is carried out between ACC and the memory and the digit address is incremented to specify a one digit upper position. The memory address is still at $m_A$. XD is repeated executed through $P_4$ and $P_3$. By the step ACC→M, "0" is transmitted from ACC to the least significant digit position of the memory which in turn provides its original contents for ACC. When the digit address is up via $P_3$ and XD is about to be executed at $P_3$ via $P_4$, the second least significant digit is selected to contain the original content of the least significant digit position which has previously been contained within ACC. At this time ACC is allowed to contain the contents of the second least significant digit position. The most significant digit is previously selected as $n_1$. If the transmission step reaches the most significant digit position, $BL=n_1$ is satisfied and $P_4$ is skipped. In other words, the digit contents are shifted up to thereby conclude the processing of Type 2.

$P_4$ . . . XI is repeated at $P_3$ until BL=V.

(VIII) PROCEDURE OF SETTING OR RESETTING A ONE-BIT CONDITION F/F ASSOCIATED WITH A SPECIFIC REGION OF THE MEMORY (Type 1)

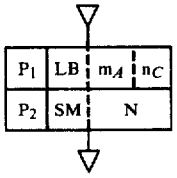

$P_1$ . . . The file address $m_B$ and the digit address $n_C$ of a region of the memory to be processed are determined.

$P_2$ . . . "1" is loaded into a desired bit N within the digit position of the memory specified by $P_1$, thus concluding the processing of Type 1.

(Type 2)

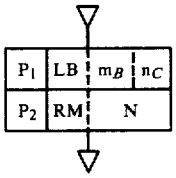

$P_1$ . . . The file address $m_B$ and the digit address $n_C$ of a region of the memory to be processed are determined.

$P_2$ . . . "0" is loaded into a desired bit N within the digit position of the memory specified by $P_1$, thus concluding the processing of Type 2.

(IX) PROCEDURE OF SENSING THE STATE OF THE ONE-BIT CONDITIONAL F/F ASSOCIATED WITH A SPECIFIC REGION OF THE MEMORY AND CHANGING A NEXT PROGRAM ADDRESS (STEP) AS A RESULT OF THE SENSING OPERATION

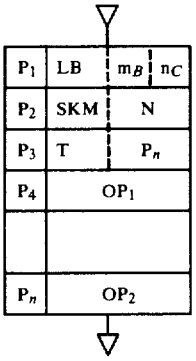

$P_1$ . . . There are specified the file address $m_B$ and the digit address $n_C$ where a desired one-bit conditional F/F is present.

$P_2$ . . . In the case where the contents of the bit position (corresponding to the conditional F/F) specified by N within the memory region as selected during $P_1$ assume "1", the step proceeds to $P_4$ with skipping $P_3$, thus executing the operation $OP_1$. In the event that the desired bit position bears "0", the next step $P_3$ is skipped.

$P_3$ . . . When the foregoing $P_2$ has been concluded as the conditional F/F in the "0" state, the program step $P_n$ is selected in order to execute the operation $OP_2$.

(X) PROCEDURE OF DECIDING WHETHER THE DIGIT CONTENTS OF A SPECIFIC REGION OF THEMEMORY REACH A PRESELECTED NUMERAL AND ALTERING A NEXT PROGRAM ADDRESS (STEP) ACCORDING TO THE RESULTS OF THE DECISION

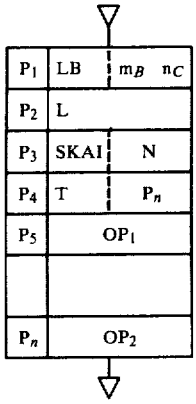

$P_1$ . . . The region of the memory which contains contents to be decided is identified by the file address $m_B$ and the digit address $n_C$.

$P_2$ . . . The contents of the memory as identified during $P_1$ are unloaded into ACC.

$P_3$ . . . The contents of ACC are compared with the preselected value N and if there is agreement the step advances toward $P_5$ without executing $P_4$ to perform the operation $OP_1$. $P_4$ is however reached if the contents of ACC are not equal to N.

$P_4$ . . . The program address (step) $P_n$ is then selected to perform the operation $OP_2$.

(XI) PROCEDURE OF DECIDING WHETHER THE PLURAL DIGIT CONTENTS OF A SPECIFIC REGION OF THE MEMORY ARE EQUAL TO A PRESELECTED NUMERAL AND ALTERING A PROGRAM STEP ACCORDING TO THE RESULTS OF THE DECISION

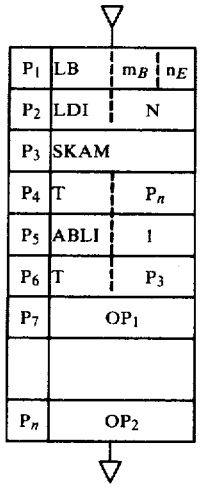

$P_1$ . . . The region of the memory to be judged is identified by the file address $m_B$ and the first digit address $n_E$.

$P_2$ . . . The value N is loaded into ACC for comparison.

$P_3$ . . . The value V within ACC is compared with the digit contents of the specific region of the memory and if there is agreement $P_5$ is reached without passing $P_4$ to advance the comparison operation toward the next succeeding digit. $P_4$ is selected in a non-agreement.

$P_4$ . . . In the case of a non-agreement during $P_3$ the program address (step) $P_n$ is specified to execute the operation forthwith.

$P_5$ . . . The digit address is incremented by adding "1" thereto. This step is aimed at evaluating in sequence a plurality of digits within the memory. The ultimate digit to be evaluated is previously determined as (V). The comparison is repeated throughout the desired digit positions. If a non-agreement state occurs on the way, the operation $OP_2$ is accomplished through $P_4$. In the case where the agreement state goes on till BL=V, there is selected $P_7$ rather than $P_6$ to perform the operation $OP_1$.

$P_6$ . . . When the agreement state goes on during $P_5$, $P_3$ is reverted for evaluation.

(XII) PROCEDURE OF DECIDING WHETHER THE CONTENTS OF A SPECIFIC REGION OF THE MEMORY ARE SMALLER THAN A GIVEN VALUE AND DECIDING WHICH ADDRESS (STEP) IS TO BE EXECUTED

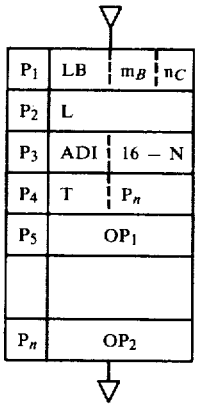

$P_1$ . . . The file address $m_B$ and the digit address $n_C$ of the memory are decided.

$P_2$ . . . The contents of the memory as specified during $P_1$ are unloaded into ACC.

$P_3$ . . . N is the value to be compared with the contents of the memory and the operand area specifies 16−N which in turn is added to the contents of ACC, the sum thereof being loaded back to ACC. The occurrence of a fourth bit carry during the addition suggests that the result of the binary addition exceeds 16, that is, $M+(16-N) \geqq 16$ and hence $M \geqq N$. The step is progressed toward $P_4$.

$P_4$ . . . When $M \geqq N$ is denied, the program step $P_n$ is selected to carry out the operation $OP_2$.

(XIII) PROCEDURE OF DECIDING WHETHER THE CONTENTS OF A SPECIFIC REGION OF THE MEMORY ARE GREATER THAN A GIVEN VALUE AND DECIDING WHICH ADDRESS (STEP) IS TO BE EXECUTED

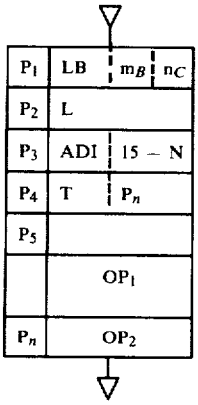

$P_1$ . . . The file address $m_B$ and the digit address $n_C$ of the memory are decided.

$P_2$ . . . The contents of the memory as specified during $P_1$ are unloaded into ACC.

$P_3$ . . . N is the value to be compared with the contents of thememory and the operand area specifies 15-N which in turn is added to the contents of ACC, the sum thereof being loaded back to ACC. The occurrence of a fourth bit carry during the addition suggests that the results of binary addition exceeds 16, that is, $M+(15-N) \geqq 16$ and hence $M \geqq N+1$ and $M>N$. The step is progressed toward $P_5$ with skipping $P_4$, thus performing the operation $OP_1$. In the absence of a carry (namely, $M>N$) the step $P_4$ is reached.

$P_4$ . . . When $M \geqq N$ is denied, the program address (Step) $P_n$ is selected to carry out the operation $OP_2$.

(XIV) PROCEDURE OF DISPLAYING THE CONTENTS OF A SPECIFIC REGION OF THE MEMORY (Type 1)

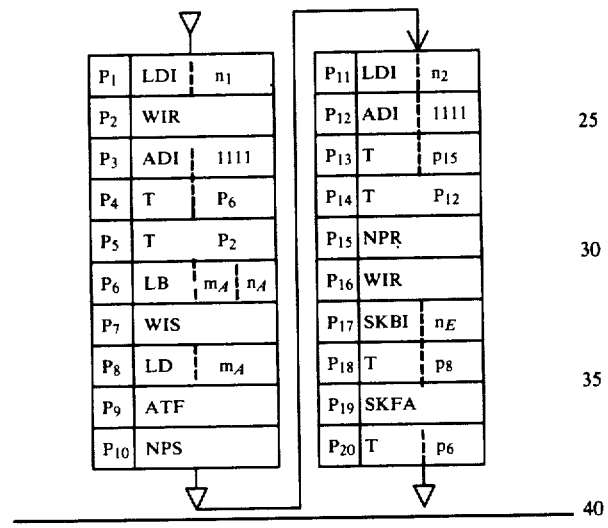

$P_1$ . . . The bit number $n_1$ of the buffer register W is loaded into ACC to reset the overall contents of the buffer register W for generating digit selection signals effective to drive a display panel on a time sharing basis.

$P_2$ . . . After the overall contents of the register W are one bit shifted to the right, its first bit is loaded with "0". This procedure is repeated via $P_4$ until $C_4=1$ during $P_3$, thus resetting the overall contents of W.

$P_3$ . . . The operand $I_A$ is decided as "1111" and AC+1111 is effected (this substantially corresponds to ACC−1). Since ACC is loaded with $n_1$ during $P_1$, this process is repeated $n_1$ times. When the addition of "1111" is effected following ACC=0, the fourth bit carry $C_4$ assumes "0". When this occurs, the step is advanced to $P_4$. Otherwise the step is skipped up to $P_5$.

$P_4$ . . . When the fourth bit carry $C_4=0$ during ACC+1111, the overall contents of W are reduced to "0" to thereby complete all the pre-display processes. The first address $P_6$ is set for the memory display steps.

$P_5$ . . . In the event that the fourth bit carry $C_4=1$ during ACC+1111, the overall contents of W have not yet reduced to "0". Under these circumstances $P_2$ is reverted to repeat the introduction of "0" into W.

$P_6$ . . . The first digit position of the memory region which contains data to be displayed is identified by the file address $m_A$ and the digit address $n_A$.

$P_7$ . . . After the contents of the register W for generating the digit selection signals are one bit shifted to the right, its first bit position is loaded with "1" and thus ready to supply the digit selection signal to the first digit position of the display.

$P_8$ . . . The contents of the specific region of the memory are unloaded into ACC. The file address of the memory still remains at $m_A$, whereas the digit address is decremented for the next succeeding digit processing.

$P_9$ . . . The contents of the memory is shifted from ACC to the buffer register F. The contents of the register F are supplied to the segment decoder SD to generate segment display signals.

$P_{10}$ . . . To lead out the contents of the register W as display signals, the conditional F/F $N_p$ is supplied with "1" and placed into the set state. As a result of this, the contents of the memory processed during $P_9$ are displayed on the first digit position of the display.

$P_{11}$ . . . A count initial value $n_2$ is loaded into ACC to determine a one digit long display period of time.

$P_{12}$ . . . ACC−1 is carried out like $P_3$. When ACC does not assume "0" (when $C_4=1$) the step is skipped up to $P_{14}$.

$P_{13}$ . . . A desired period of display is determined by counting the contents of ACC during $P_{12}$. After the completion of the counting $P_{15}$ is reached from $P_{13}$. The counting period is equal in length to a one-digit display period of time.

$P_{14}$ . . . Before the passage of the desired period of display the step is progressed from $P_{12}$ to $P_{14}$ with skipping $P_{13}$ and jumped back to $P_{12}$. This procedure is repeated.

$P_{15}$ . . . $N_p$ is reset to stop supplying the digit selection signals to the display. Until $N_p$ is set again during $P_{10}$, overlapping display problems are avoided by using the adjacent digit signals.

$P_{16}$ . . . The register W is one bit shifted to the right and its first bit position is loaded with "0". "1" introduced during $P_7$ is one bit shifted down for preparation of the next succeeding digit selection.

$P_{17}$ . . . It is decided whether the ultimate digit of the memory to be displayed has been processed and actually whether the value $n_E$ of the last second digit has been reached because the step $P_8$ of $B_L-1$ is in effect.

$P_{18}$ . . . In the event that ultimate digit has not yet been reached, $P_8$ is reverted for the next succeeding digit display processing.

$P_{19}$ . . . For example, provided that the completion of the display operation is conditional by the flag F/F FA, FA=1 allows $P_{20}$ to be skipped, thereby concluding all the displaying steps.

$P_{20}$ . . . If FA=1 at $P_{19}$, the display steps are reopened from the first display and the step is jumped up to $P_6$.

(Type 2)

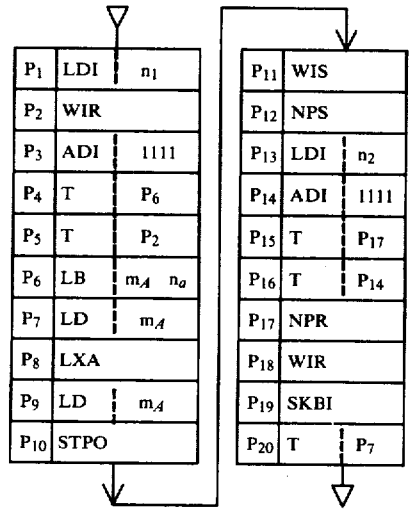

$P_1$ . . . The bit number $n_1$ of the buffer register W is loaded into ACC to reset the overall contents of the buffer register W for generating digit selection signals effective to drive a display panel on a time sharing basis.

$P_2$ . . . After the overall contents of the register W are one bit shifted to the right, its first bit is loaded with "0". This procedure is repeated via $P_4$ until $C_4=1$ during $P_3$, thus resetting the overall contents of W.

$P_3$ . . . The operand $I_A$ is decided as "1111" and AC+1111 is effected (this substantially corresponds to ACC−1). Since ACC is loaded with $n_1$ during $P_1$, this process is repeated $n_1$ times. When the addition of "1111" is effected following ACC=0, the fourth bit carry $C_4$ assumes "0". When this occurs, the step is advanced to $P_4$. Otherwise the step is skipped up to $P_5$.

$P_4$ . . . When the fourth bit carry $C_4=0$ during ACC+1111, the overall contents of W are reduced to "0" to thereby complete all the pre-display processes. The first address $P_6$ is set for the memory display steps.

$P_5$ . . . In the event that the fourth bit carry $C_4=1$ during ACC+1111, the overall contents of W have not yet reduced to "0". Under these circumstances $P_2$ is reverted to repeat the introduction of "0" into W.

$P_6$ . . . The upper four bits of the first digit position of the memory region which contains data to be displayed are identified by the file address $m_A$ and the digit address $m_A$.

$P_7$ . . . The contents of the specific region of the memory are unloaded into ACC. The file address of the memory still remains at $m_A$, whereas the digit address is decremented to specify the lower four bits.

$P_8$ . . . The contents of ACC, the upper four bits, are transmitted into the temporary register X.

$P_9$ . . . The contents of the specific region of the memory are unloaded into ACC. The file address of the memory still remains at $m_A$, whereas the digit address is decremented to specify the upper four bits of the next succeeding digit.

$P_{10}$ . . . The contents of ACC are unloaded into the stack register SA and the contents of the temporary register X into the stack register SX.

$P_{11}$ . . . After the contents of the register W for generating the digit selection signals are one bit shifted to the right, its first bit position is loaded with "1" and thus ready to supply the digit selection signal to the first digit position of the display.

$P_{12}$ . . . To lead out the contents of the register W as display signals, the conditional F/F $N_p$ is supplied with "1" and placed into the set state. As a result of this, the contents of the memory processed during $P_{10}$ are displayed on the first digit position of the display.

$P_{13}$ . . . A count initial value $n_2$ is loaded into ACC to determine a one digit long display period of time.

$P_{14}$ . . . ACC−1 is carried out like $P_3$. When ACC assumes "0" $P_{15}$ is reached and when ACC≠0 (when $C_4=1$) the step is skipped up to $P_{16}$. This procedure is repeated.

$P_{15}$ . . . A desired period of display is determined by counting the contents of ACC during $P_{14}$. After the completion of the counting $P_{17}$ is reached from $P_{15}$. The counting period is equal in length to a one-digit display period of time.

$P_{16}$ . . . Before the passage of the desired period of display the step is progressed from $P_{14}$ to $P_{16}$ with skipping $P_{15}$ and jumped back to $P_{14}$. This procedure is repeated.

$P_{17}$ . . . $N_p$ is reset to stop supplying the digit selection signals to the display. Until $N_p$ is set again during $P_{10}$, overlapping display problems are avoided by using the adjacent digit signals.

$P_{18}$ . . . The register W is one bit shifted to the right and its first bit position is loaded with "0". "1" introduced during $P_7$ is one bit shifted down for preparation of the next succeeding digit selection.

$P_{19}$ . . . It is decided whether the ultimate digit of the memory to be displayed has been processed and actually whether the value $n_E$ of the last second digit has been reached because the step $p_9$ of $B_L-1$ is in effect.

$P_{20}$ . . . In the event that ultimate digit has not yet been reached, $P_7$ is reverted for the next succeeding digit display processing.

(XV) PROCEDURE OF DECIDING WHICH KEY SWITCH IS ACTUATED (SENSING ACTUATION OF ANY KEY DURING DISPLAY

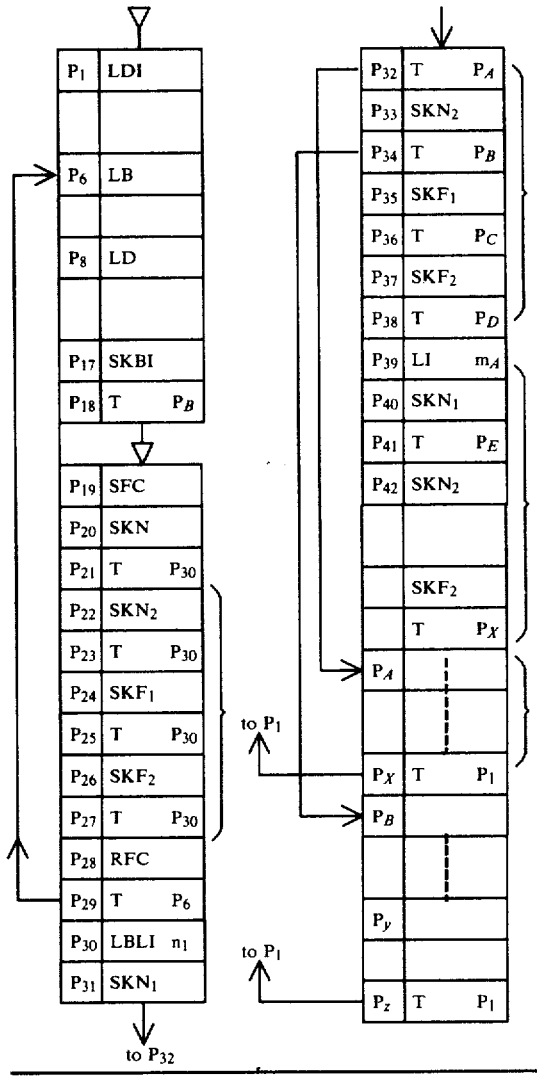

$P_1$–$P_{18}$ . . . The display processes as discussed in (XIV) above.

$P_{19}$ . . . After the overall digit contents of the register W are displayed, the flag F/F FC is set to hold all the key signals $I_l$–$I_n$ at a "1" level.

$P_{20}$ . . . The step is jumped to $P_{30}$ as long as any one of the keys connected to the key input $KN_1$ is actuated.

$P_{22}$–$P_{27}$ . . . It is decided whether any one of the keys each connected to the respective key inputs $KN_2$–$KF_2$ and in the absence of any actuation the step is advanced toward the next succeeding step. To the contrary, the presence of the key actuation leads to $P_{30}$.

$P_{28}$ . . . When any key is not actuated, F/F FC is reset to thereby complete the decision as to the key actuations.

$P_{29}$ . . . The step is jumped up to $P_6$ to reopen the display routine.

$P_{30}$ . . . When any key is actually actuated, the memory digit address is set at $n_1$ to generate the first key strobe signal $I_1$.

$P_{31}$ . . . It is decided if the first key strobe signal $I_1$ is applied to the key input $KN_1$ and if not the step is advanced toward $P_{33}$.

$P_{32}$ . . . When the first key strobe signal $I_1$ is applied to the key input $KN_1$, which kind of the keys is actuated is decided. Thereafter, the step is jumped to $P_A$ to provide proper controls according to the key decision. After the completion of the key decision the step is returned directly to $P_1$ to commence the displaying operation again ($P_Z$ is to jump the step to $P_1$)

$P_{33}$–$P_{38}$ . . . It is sequentially decided whether the keys coupled with the first key strobe signal $I_1$ are actuated. If a specific key is actuated, the step jumps to $P_B$–$P_D$ for providing appropriate controls for that keys.

$P_{39}$ . . . This step is executed when no key coupled with the first key strobe signal $I_1$. This step is to increment the digit address of the memory for the developments of the key strobe signals.

$P_{41}$ and up . . . The appropriate key strobe signals are developed and $KN_1$–$KF_2$ are sequentially monitored to decide what kind of the keys are actuated. Desired steps are then selected to effects control steps for those actuated keys.

$P_A$ and up . . . Control steps for the first actuated keys.

$P_X$ . . . $P_1$ is returned to reopen the display operation after the control steps for the first key.

The foregoing is the description of the respective major processing events in the CPU architecture.

By reference to FIGS. 6 and 7 an example of the display operation of a calculator implementing the display device according to the present invention will now be described in detail.

Figure 8:
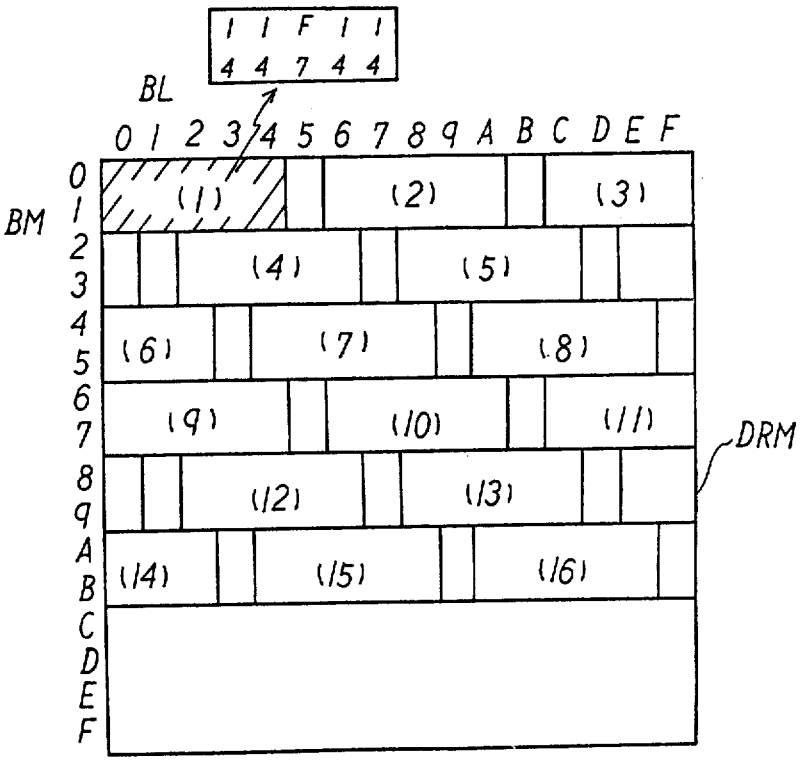
FIG. 8 is a block diagram of a displaying data storage area.
Figure 9:
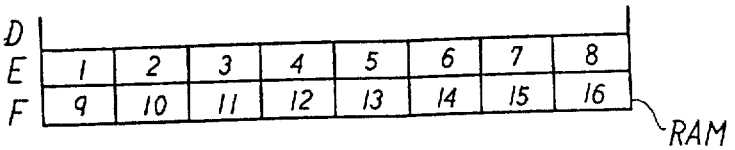
FIG. 9 is a block diagram of part of a random access memory (RAM) of the CPU architecture.

FIG. 7 exemplifies a manner by which a pattern "I" is displayed on upper and lower rows of the 7×5 dot matrix display panel by use of the segment signals $S_1$–$S_{40}$ and the opposing electrode output signals $H_1$–$H_7$ after the storage contains "11F1144744" (see FIG. 7(*b*)). The displaying data storage area DRM stores temporarily those displaying data as depicted in FIG. 8. The encoded information is stored within the areas (1)–(16), with the area (1) storing the encoded information "11F1144744." Also, the same encoded information is stored in part of the RAM of the CPU as shown in FIG. 9 as do the areas (1)–(16).

The displaying data storage area DRM of FIG. 8 is able to store the character data (1)–(16) but actually the encoded information within the area covering from $B_BB_L$ (0, 0) to $B_MB_L$ (5, 7) may be displayed and all of the character data are not displayed at a time. The characters on the display panel shifts dot by dot at a given period of time by shifting the selected address $B_MB_L$ (0, 0)–$B_MB_L$ (B, F) of the displaying data storage area DRM in the display control circuitry DSC digit by digit at the given period of time through the action of the CPU.

Figure 10:
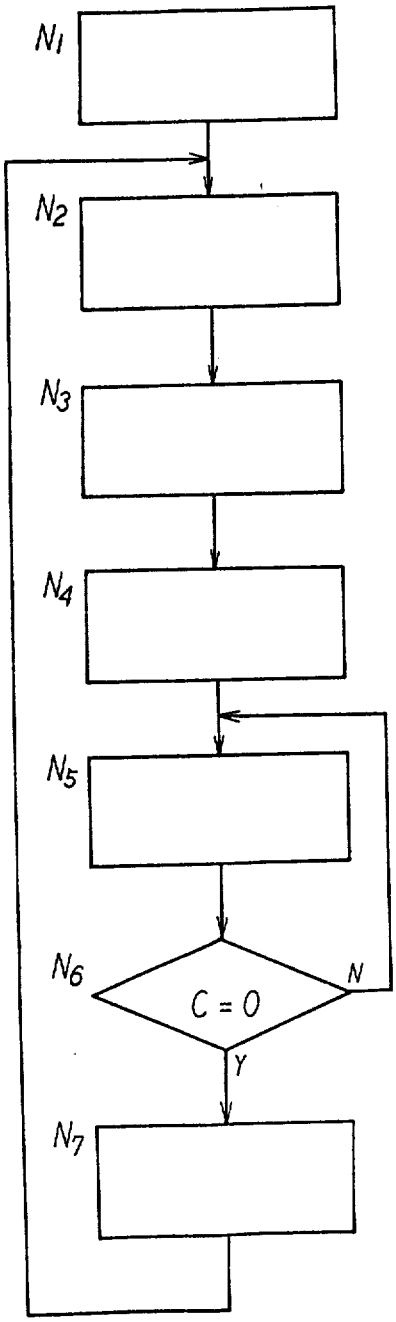
FIG. 10 is a flow chart for explanation of the display operation in the illustrated calculator.

FIG. 10 is a flow chart of the running display operation which achieves dot by dot movement of the display contents. By the step $N_1$ the display is disabled and the DRM is loaded with the data to be running displayed. The step $N_2$ loads the count indicative of the speed of the running display operation into the display counter. The step $N_3$ loads the next address of the DRM into the accumulator to shift the address digit by digit. The step $N_4$ enables the display operation and the step $N_5$ decrements the display counter. The display operation goes on until the counter reaches "zero" as sensed by the counter which determines the speed of the running display operation. The step $N_7$ disables the display operation, followed by the SHIFT routine. The running display mode is completed in this manner.

Figure 11A:
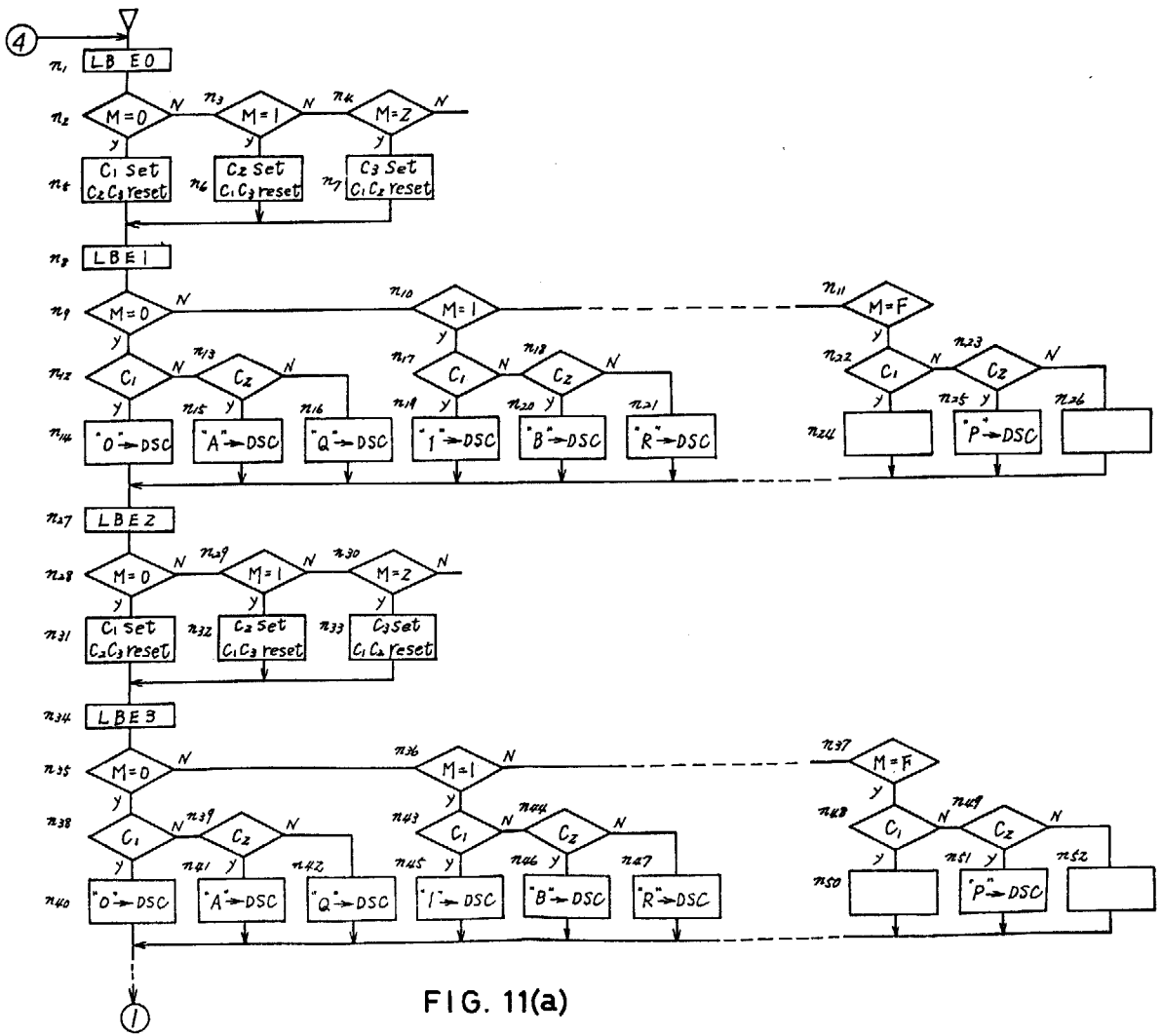
FIGS. 11(*a*) through 11(*c*) are details of the operation shown in FIG. 10.
Figure 11B:
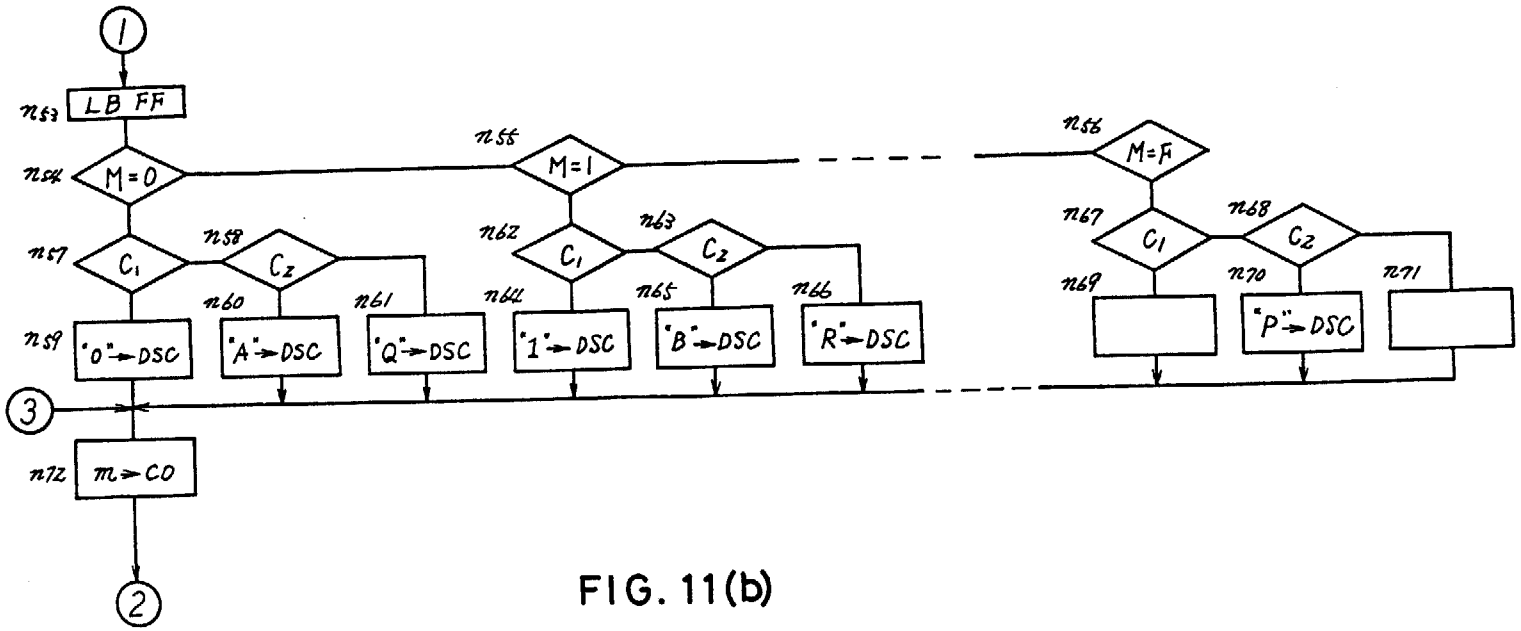
Figure 11C:
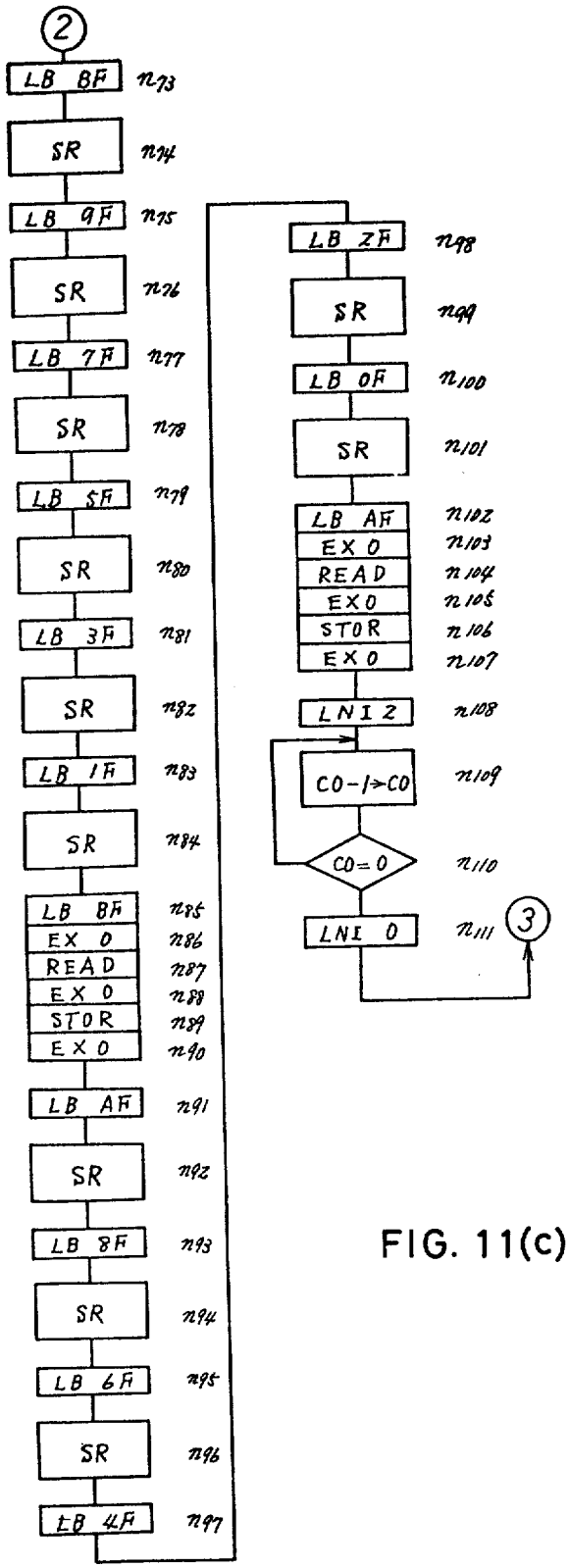

FIG. 11 is a flow chart for explanation of the operation shown in FIG. 10 through the utilization of the circuit arrangement of FIGS. 2 through 4. Assume now that the displaying data have already stored within the RAM of the CPU. It is noted that the respective steps $n_1, n_2 \ldots n_{111}$ are listed in FIG. 12. Each of the characters 0, 1, 2, . . . 8, 9, a, b, c, . . . x, y, z is stored within the RAM of the CPU in the form of the encoded signals of FIG. 13. As is clear from FIG. 13, if the lower 4 bits are "0000", then the numerical information is present. If the lower 4 bits are "0001", the alphabetic characters a–p are evaluated and if the lower 4 bits are "0010" the remaining alphabetic characters q–z are evaluated.

The steps and their contents in FIG. 11 will now be discussed.

$n_1$: the address EO of the RAM of the CPU is selected.

$n_2$: it is decided as to whether the address EO is "0000"

$n_3$: it is decided as to whether the address EO is "0001"

$n_4$: it is decided as to whether the address EO is "0010"

$n_5$: the selected bit $C_1$ of the RAM is set and $C_2$ and $C_3$ are reset.

$n_6$: the selected bit $C_2$ of the RAM is set and $C_1$ and $C_3$ are reset.

$n_7$: the selected bit $C_3$ of the RAM is set and $C_1$ and $C_2$ are reset.

$n_8$: the address $E_1$ of the RAM of the CPU is selected.

$n_9$: whether the address $E_1$ is "0000" is decided.

$n_{10}$: whether the address $E_1$ is "0001" is decided.

$n_{11}$: whether the address $E_1$ is "1111" is decided.

$n_{12}$: whether $C_1$ is set or reset is decided.

$n_{13}$: whether $C_2$ is set or reset is decided.

Figures 14, 15A:
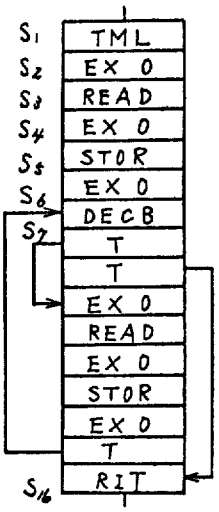
FIG. 14 shows a program for storing encoded signals for displaying a character "I"

$n_{14}$: the character pattern corresponding to the data "0" is loaded into the displaying data storage area DRM (the program effective in displaying the character "I" is illustrated in FIG. 14).

$n_{15}$: the character pattern indicative of the data "A" is loaded into the displaying data storage area DRM.

$n_{16}$: the character pattern indicative of the data "Q" is loaded into the storage area.

$n_{17}$–$n_{26}$: the steps $n_{12}$–$n_{16}$ are repeated.

$n_{27}$: the address $E_2$ of the RAM of the CPU is selected.

$n_{28}$–$n_{33}$: same as the above mentioned steps $n_2$–$n_7$.

$n_{34}$: the address $E_3$ of the RAM of the CPU is selected.

$n_{35}$ up to $n_{52}$: same as the above steps $n_{12}$–$n_{26}$.

$n_{53}$: the address FF of the RAM of the CPU is selected.

$n_{54}$ up to $n_{71}$: same as the steps $n_{12}$–$n_{26}$.

$n_{72}$: the value m is loaded into the counter CO which may be part of the RAM.

$n_{73}$: the address BF of the DRM is selected.

Figure 15B:
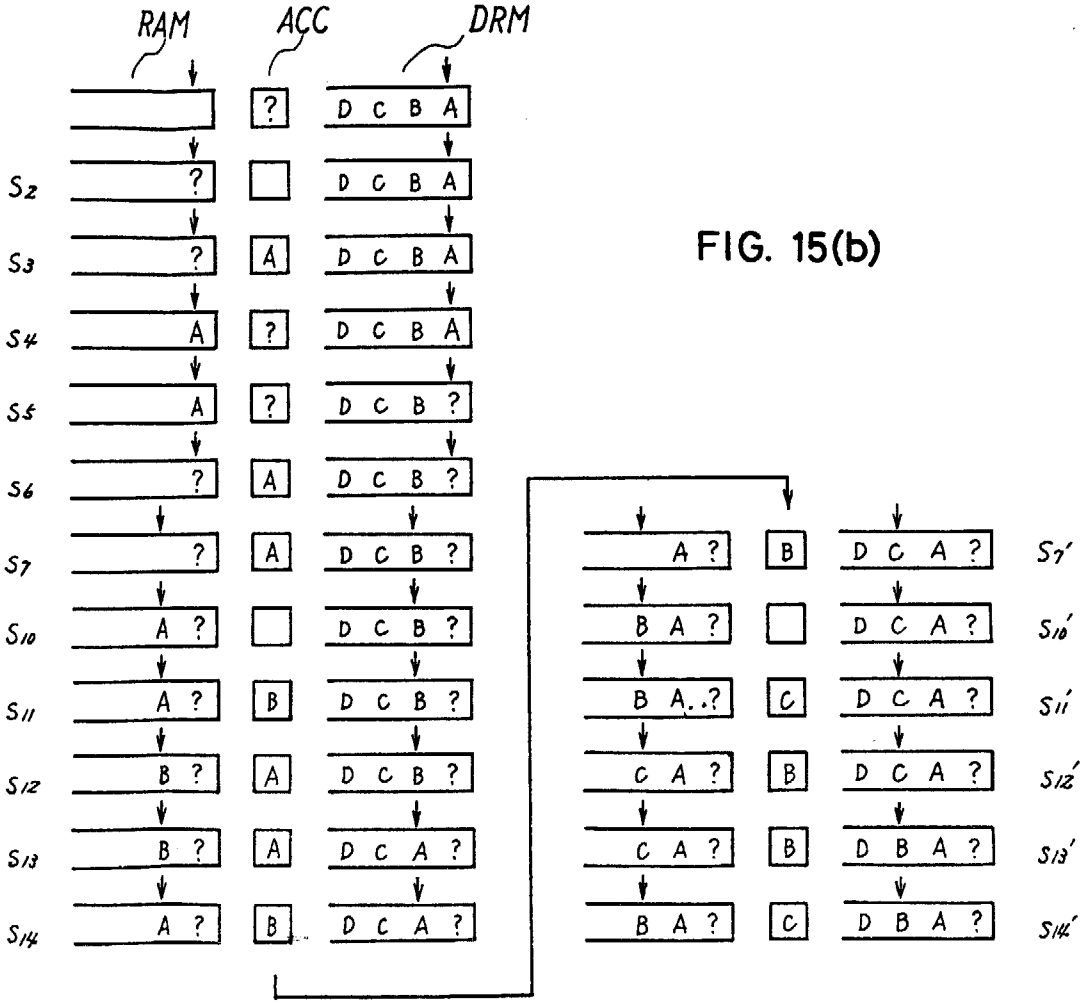
FIG. 15(*a*) is a program for shifting the contents of the displaying data storage area and FIG. 15(*b*) shows events for achieving the shift operation.

$n_{74}$: the file address B is shifted by one digit via the subroutine SR. This step is shown in FIG. 15.

$S_1$ TML: upon the completion of the subroutine the address of the ROM is stored to return to the main routine.

$S_2$ EXO: exchange takes place between the memory storing the selected address of the RAM of the CPU and the accumulator ACC. The address of the memory file remains unchanged.

$S_3$ READ: the selected address of the DRM is read into the accumulator.

$S_4$ EXO: exchange takes place between the contents of the accumulator and the contents of the memory stored at the selected address of the RAM of the CPU.

$S_5$ STOR: the contents of the accumulator ACC are unloaded into the DRM at the selected address.

$S_6$ EXO: exchange occurs between the contents of the accumulator ACC and the contents of the RAM.

$S_7$ DECB: the digit address counter $B_L$ is decremented. By the following steps the contents of the DRM are shifted via repeated execution of the program with varying the digit address. Eventually, $S_{16}$ RIT: the address of the ROM is regained for the main routine.

Thereafter, the respective file addresses 9, 7, 5, 3, 1 are shifted by one digit through the steps $n_{75}$–$n_{84}$. The steps $n_{85}$–$n_{90}$ makes up a routine for transferring the contents of the address $B_M$, $B_L$ (1, 0) into the addresses B, F. In this manner, the lower 3 dots of FIG. 6 are shifted left by one dot. The steps $n_{91}$–$n_{101}$ are a routine for shifting left the respective file addresses A, 8, 6, 4, 2, 0 by one dot in the same manner as the steps $n_{73}$–$n_{84}$.

The steps $n_{102}$–$n_{107}$ shift the contents of the address $B_MB_L$: 0, 0 to AF. Accordingly, the steps $n_{91}$–$n_{107}$ shift left the upper 4 dots of the character by one dot. The step $n_{108}$ sets the display controlling flag $N_1$ so that the segment driver SED provides the segment signals $S_1$–$S_{40}$, thus displaying the data out of the displaying storage area DM. By the action of the step $n_{109}$ the counter keeps decrementing until CO="0." When CO="0" the instruction $n_{111}$ places the displaying controlling flag $N_1$ into the reset state. Consequently, SED turns OFF $S_1$–$S_{40}$, thus disabling the display operation. Then, the step $n_{72}$ is returned to shift the contents of the displaying data storage area during the disable period.

Figure 16:
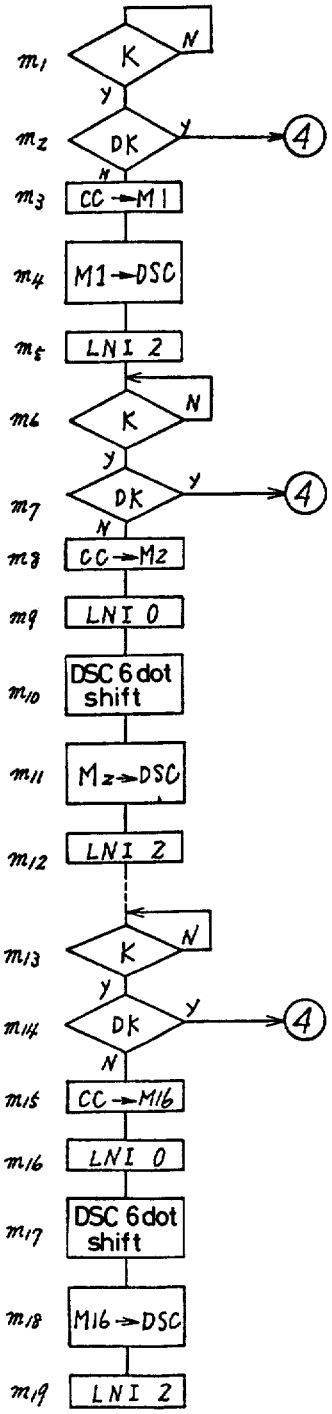
FIG. 16 is a flow chart of a display operation for keyed information.

FIG. 16 is a flow chart associated with the display operation on keyed inputs, wherein a display of the actuated key is shifted each time the keys are actuated as is obvious in the calculator art other than shifting that dot by dot.

In FIG. 16, the step $m_1$ should be inserted into an appropriate position in the routine shown FIG. 11, followed by the step $m_2$ when any keyed input is sensed. The step $m_2$ is executed to check if a display key is actuated and, if NO, regards that a character key not the display key has been actuated, thus leading to the step $m_3$ by which the character code corresponding to that character key is introduced into the first character position of the register within the memory. The step $m_4$ places that character pattern into the displaying data storage area DRM. The step $m_5$ sets the displaying flag $N_1$ and enables the contents of the DRM to be displayed. When the second character is inputted, a sequence of the steps $m_6$ $m_7$ $m_8$ is executed to transfer that character code into the second character position of the register within the memory. The step $m_9$ *discontinues the display operation. The step* $m_{10}$ shifts the 6 dots within the data storage area DRM. After the second character pattern is loaded into DRM, the instruction $m_{12}$ starts the display operation. In this manner, keyed information is loaded and displayed simultaneously. If the display key DK is actuated subsequently to the introduction of the character, then the routine 4 as shown in FIG. 11 is selected to attain the dot by dot movement on the display panel.

Whereas the present invention has been described with respect to specific embodiments thereof, it will be understood that various changes and modifications will be suggested to one skilled in the art, and it is intended to encompass such changes and modifications as fall within the scope of the appended claims.

We claim:

1. An electronic calculator and display system comprising:

a central processing unit;

a dot matrix display arranged in a number of display segments;

display information memory means for storing information to be displayed at fixed locations therein;

display read and write control circuit for storing and reading information in said display information memory means;

display buffer means for reading and decoding the information stored in said display information memory means;

display address decoder means responsive to said central processing unit for selecting addresses within said display information memory from which information is read and decoded by said display buffer means;

segment driver means for converting the decoded information developed by said display buffer means into individual segment signals for application to the individual display segments of said dot matrix display;

information volume detection means for producing a display shift signal when the number of characters of said information to be displayed stored in said display information memory means exceeds the number of display segments;

said display address decoder means and said central processing unit sequentially shifting the addresses of said display information memory means to be read by said display buffer means in response to the production of said display shift signal by said information volume detection means to thereby shift said information across said display to form a running display pattern.

2. The system of claim 1 wherein said information volume detection means further includes numerical information determination means inhibiting the production of said display shift signal when said information to be displayed is numerical information produced by an arithmetic operation.

* * * * *